US010267069B2

(12) United States Patent
Zhang

(10) Patent No.: US 10,267,069 B2
(45) Date of Patent: Apr. 23, 2019

(54) DOOR LATCH ACTUATOR

(71) Applicant: MITSUI KINZOKU ACT CORPORATION, Kanagawa (JP)

(72) Inventor: Chenming Zhang, Kanagawa (JP)

(73) Assignee: Mitsui Kinzoku Act Corporation (JP)

( * ) Notice: Subject to any disclaimer, the term of this patent is extended or adjusted under 35 U.S.C. 154(b) by 178 days.

(21) Appl. No.: 15/317,142

(22) PCT Filed: Nov. 12, 2014

(86) PCT No.: PCT/JP2014/079913
§ 371 (c)(1),
(2) Date: Dec. 8, 2016

(87) PCT Pub. No.: WO2016/021084
PCT Pub. Date: Feb. 11, 2016

(65) Prior Publication Data

US 2017/0138096 A1 May 18, 2017

(30) Foreign Application Priority Data

Aug. 5, 2014 (JP) ..... 2014-159257

(51) Int. Cl.
*E05B 81/36* (2014.01)
*E05B 77/38* (2014.01)
(Continued)

(52) U.S. Cl.
CPC ..... *E05B 81/36* (2013.01); *E05B 77/34* (2013.01); *E05B 77/38* (2013.01); *E05B 81/06* (2013.01);
(Continued)

(58) Field of Classification Search
CPC ..... E05B 81/06; E05B 81/16; E05B 81/34; E05B 81/36; E05B 81/54; E05B 77/34; E05B 77/38; E05B 85/02
(Continued)

(56) References Cited

U.S. PATENT DOCUMENTS 4,727,301 A * 2/1988 Fulks ..... E05B 81/25 292/DIG. 23
5,649,726 A * 7/1997 Rogers, Jr. ..... E05B 81/06 292/201
(Continued)

FOREIGN PATENT DOCUMENTS

JP 2007-211506 A 8/2007
JP 2007-321467 A 12/2007
(Continued)

*Primary Examiner* — Suzanne L Barrett
(74) *Attorney, Agent, or Firm* — Skinner and Associates; Joel Skinner

(57) ABSTRACT

A door latch actuator comprises a reversible motor, a rotating object, a drive portion and an actuating member. The drive portion comprises two locking/unlocking drive projections and stopping projections. The actuating member comprises a pair of driven portions. When the drive portion is rotated in one direction, one of the locking/unlocking drive projections comes in contact with one of the driven portions to move the actuating member to a lock position. When the actuating member is moved to the lock position, the locking/unlocking drive projection leaves a recess, and the stopping projection comes in contact with the actuating member to stop rotation of the drive portion. When the drive portion rotates in an opposite direction, the other locking/unlocking drive projection comes in contact with the other driven portion, so that the actuating member is moved toward an unlock position. When the actuating member is moved to the unlock position, the other locking/unlocking drive projection leaves the recess, and the stopping projec-
(Continued)

tion comes in contact with the actuating member thereby stopping rotation of the drive portion.

7 Claims, 18 Drawing Sheets

(51) Int. Cl.

| | |
|---|---|
| ***E05B 77/34*** | (2014.01) |
| ***E05B 81/06*** | (2014.01) |
| ***E05B 81/16*** | (2014.01) |
| ***E05B 81/54*** | (2014.01) |
| *E05B 81/34* | (2014.01) |
| *E05B 85/02* | (2014.01) |

(52) U.S. Cl.
CPC ..... *E05B 81/16* (2013.01); *E05B 81/54* (2013.01); *E05B 81/34* (2013.01); *E05B 85/02* (2013.01)

(58) Field of Classification Search
USPC ..... 70/279.1, 275, 280–283.1
See application file for complete search history.

(56) References Cited

U.S. PATENT DOCUMENTS

| | | | | |
|---|---|---|---|---|
| 6,655,179 | B2 * | 12/2003 | Kobayashi | E05B 77/28 70/237 |
| 7,448,237 | B2 * | 11/2008 | Shimada | E05B 77/34 292/201 |
| 7,621,571 | B2 * | 11/2009 | Umino | E05B 85/06 292/201 |
| 7,703,310 | B2 * | 4/2010 | Usuzaki | E05B 17/041 292/125 |
| 8,256,805 | B2 * | 9/2012 | Ishiguro | E05B 77/26 292/201 |
| 8,678,452 | B2 * | 3/2014 | Nagaoka | E05B 77/265 292/201 |
| 8,726,705 | B2 * | 5/2014 | Tabe | E05B 79/04 70/237 |
| 9,140,037 | B2 * | 9/2015 | Nagaoka | E05B 77/34 |
| 9,758,995 | B2 * | 9/2017 | Kalsi | E05B 77/38 |

FOREIGN PATENT DOCUMENTS

| | | | |
|---|---|---|---|
| JP | 2011-226173 | A | 11/2011 |
| JP | 2012-112242 | A | 6/2012 |
| JP | 2013-217050 | A | 10/2013 |
| JP | WO2013/150681 | | 10/2013 |

* cited by examiner

FIG.7A (New Sheet)
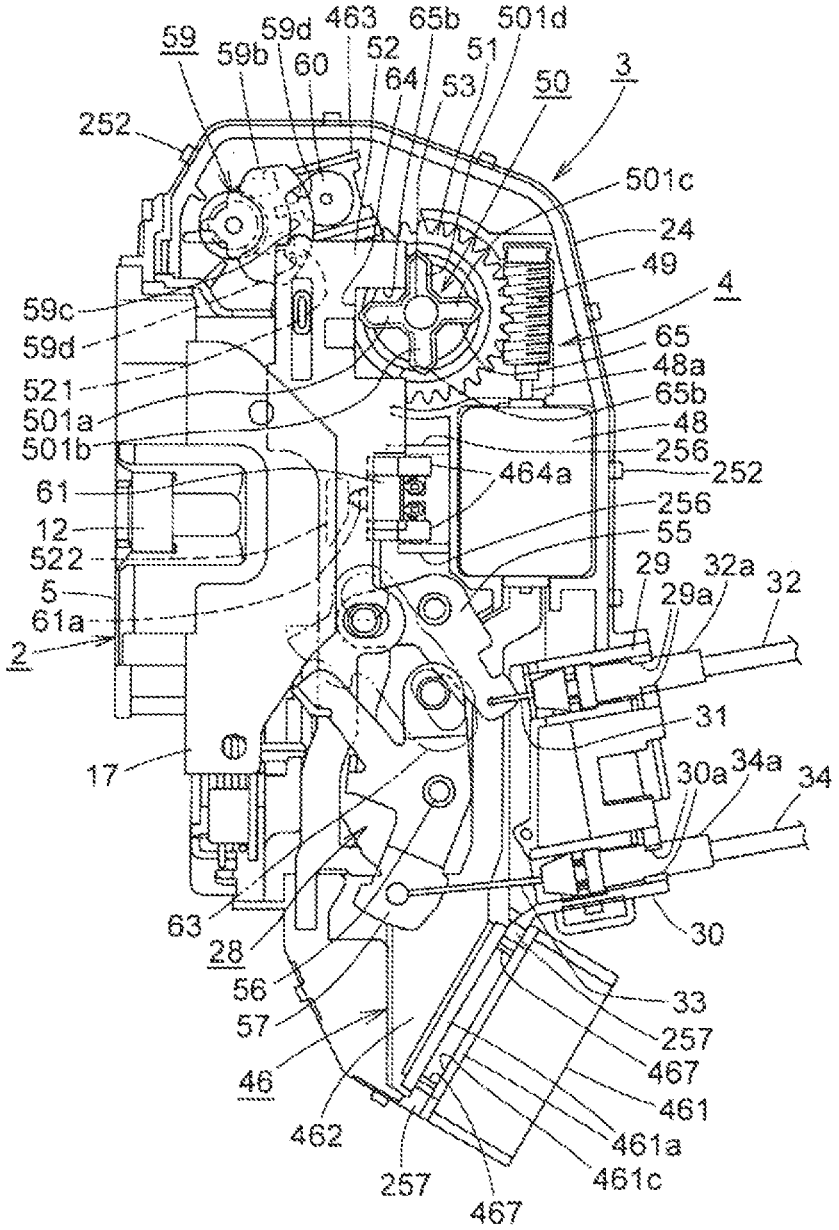

DOOR LATCH ACTUATOR

BACKGROUND OF THE INVENTION

The present invention relates to a door latch actuator disposed in a door latch device of a vehicle to switch a locking mechanism in a door latch device to a lock state and an unlock state.

As described in JP2007-211506A, a conventional door latch actuator comprises a reversible motor; a worm wheel rotated by the motor; a pinion fixed to a rotary shaft of the worm wheel; and an actuating member that actuates a locking mechanism of the door latch device to a lock position for a lock state and an unlock state for an unlock state.

JP2013-217050A discloses an actuator that comprises a reversible motor; a worm wheel rotated by the motor; three teeth equally spaced on a rotary surface of the worm wheel; and a lock lever that comes in contact with any one of the three teeth based on rotation of the worm wheel, wherein the teeth is rotated together with the worm wheel by the motor to rotate the lock lever to a lock position and an unlock position to switch the door latch device to a lock state and an unlock state.

In order to make the actuator in JP2007-211506A smaller and lighter, a drive torque has to become greater and a diameter of the pinion has to be made as small as possible, which increases operation time of the motor for moving the actuating member with the pinion from an unlock position to a lock position and vice versa and increases a rotation angle of the worm wheel driven by the motor and of the pinion. Thus, there is a problem that operation time of the actuator with the motor is long until the door latch device is switched to the lock state and the unlock state.

The actuating member is moved to the lock position and the unlock position by manually operating means such as a knob lever and a key cylinder. Because the pinion always meshes with the actuating member, the worm wheel and the motor rotate together to make a motion of the manually operating means leaden when the actuating member is moved by the manually operating means.

In the actuator in JP2013-217050A, the three teeth are spaced circumferentially by nearly 120 degrees, and each of the teeth is in contact with the lock lever, increasing a rotation angle of the worm wheel for rotating the lock lever to the lock position and the unlock position and thus increasing operation time of the actuator for switching the door latch device to the lock state and the unlock state.

SUMMARY OF THE INVENTION

In view of the disadvantages, it is an object of the present invention to provide a door latch actuator that reduces operation time for switching a door latch device to a lock state and an unlock state, wherein manually operating means can be operated by a small force.

BRIEF DESCRIPTION OF THE DRAWINGS

FIG. 7A is a left side elevational view of the door latch device from which a cover is removed (a buffer member 65 is attached on a drive portion 50).

DETAILED DESCRIPTION OF PREFERRED EMBODIMENT

One embodiment of the present invention will be described with respect to the drawings as below.

In FIGS. 1 to 7, a door latch device 1 comprises an engagement unit 2 fixed to the rear end of an inner panel D1 of a door D; an operation unit 3 integrally connected to the engagement unit 2; and an actuator 4 according to the present invention in the operation unit 3.

Figure 1:
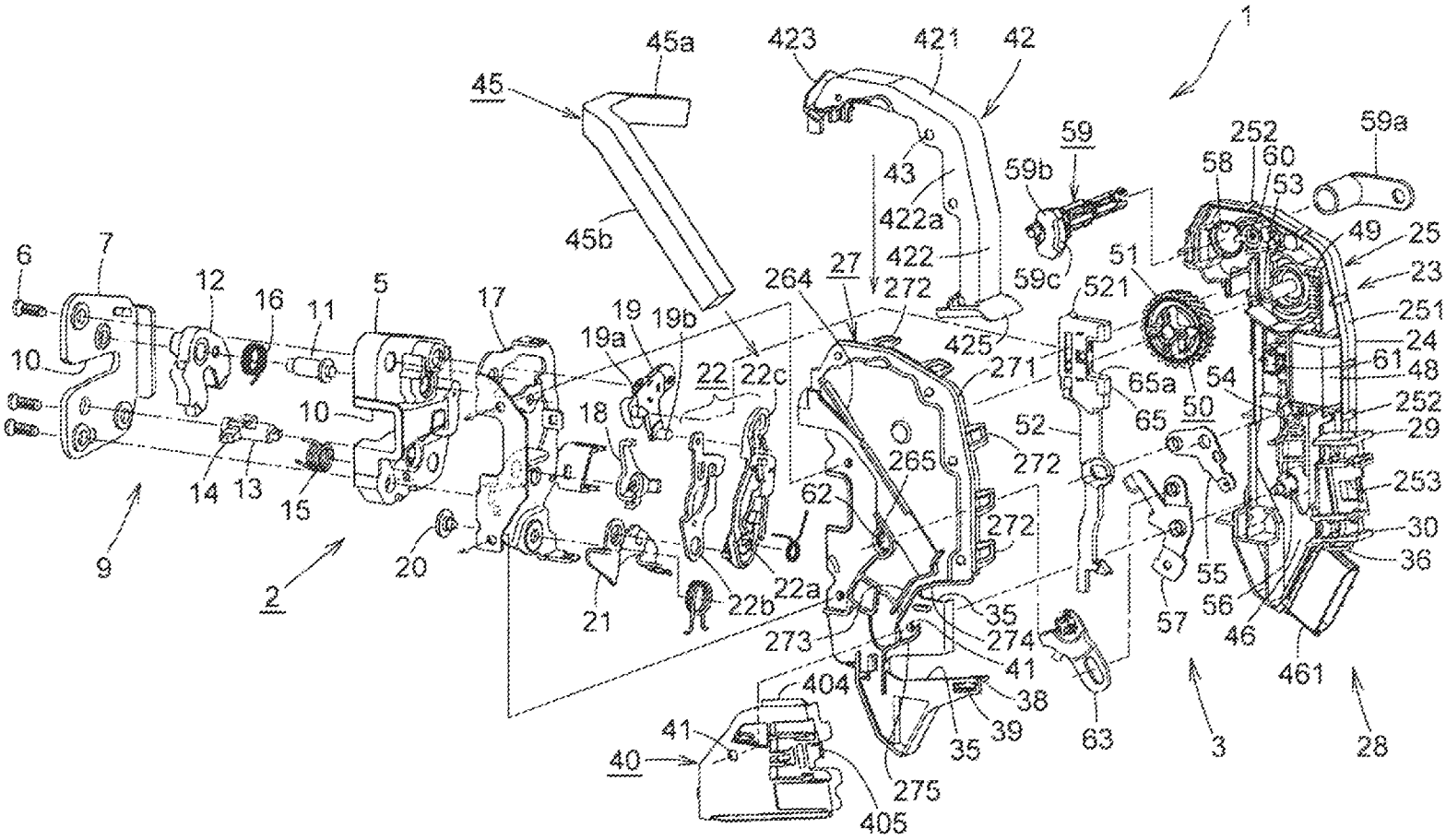
FIG. 1 is an exploded perspective view showing one embodiment of a door latch device comprising an actuator according to the present invention.
Figure 2:
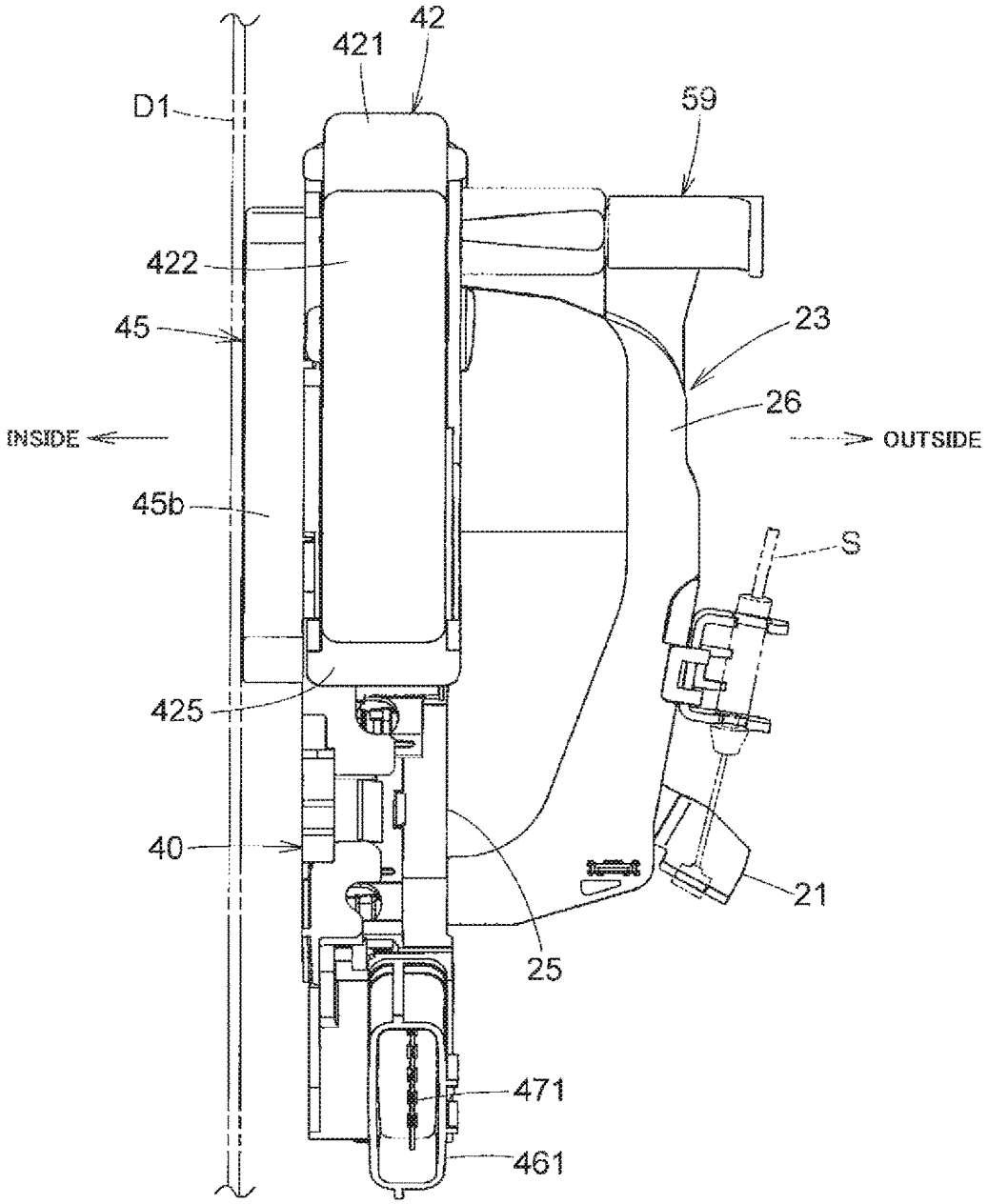
FIG. 2 is a front elevational view of the door latch device in FIG. 1 seen from front of a vehicle after assembling it.
Figure 3:
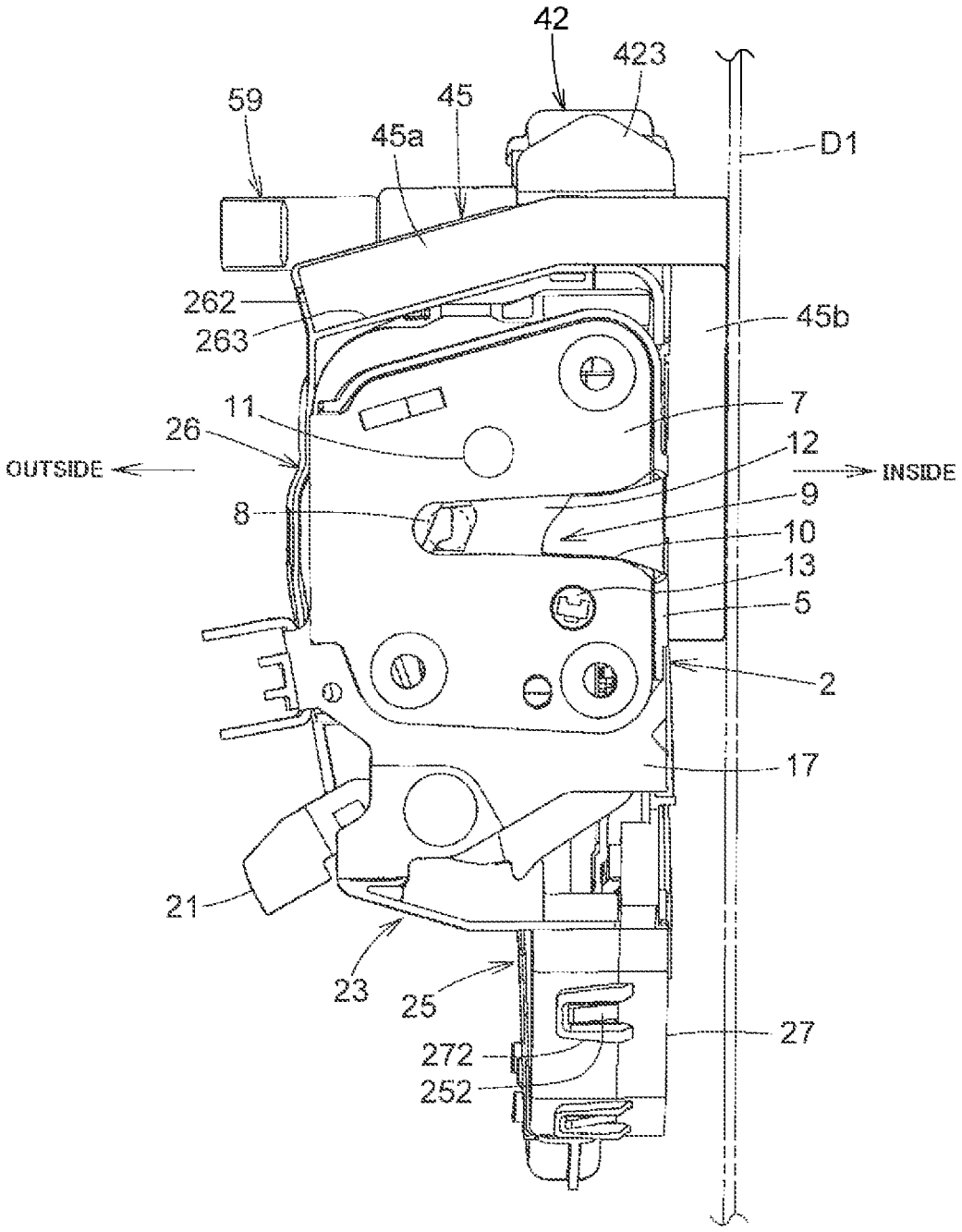
FIG. 3 is a back elevational view of the door latch device.

In FIGS. 1 and 3, the engagement unit 2 comprises a synthetic-resin box-like body 5; and a metal cover member 7 fixed with a body 5 to a rear part of the inner panel D1 in the door. Within a space between the body 5 and the cover plate 7, there is housed an engagement mechanism 9 for holding the door closed. In the body 5 and the cover plate 7, there is formed a striker-entering groove 10 into which a striker 8 comes.

The engagement mechanism 9 is pivotally mounted in the body 5 via a pivot shaft 11, and comprises a latch 12 that engages with the striker 8 of a vehicle body, and a locking portion 14 pivotally mounted in the body 5 via a pivot shaft 13 to engage with an outer circumference of the latch 12 thereby preventing the latch 12 from turning in an opening direction or counterclockwise in FIG. 3. The latch 12 is forced in an opening direction by a spring 16 wound around the pivot shaft 11.

When the latch 12 turns from an open position to a closed position, the locking portion 14 turns from an engagement position where it engages with the striker 8 against a force of a spring 15 for urging the locking portion 14 in an engagement direction, and engages with an outer circumference of the latch 12 to prevent the latch 12 from turning in an opening direction. With a door-opening outside handle on the door outside the vehicle or an inside handle (not shown) on the door inside the vehicle, an opening lever 18 later described is released, so that the locking portion 14 turns from the engagement position where it engages with the outer circumference of the latch 12 in a releasing direction to enable the door to open.

Over a front surface of the body 5, an L-shaped metal base member 17 fixed to a housing 23 later described is mounted, and an opening lever 18 fixed to the pivot shaft 13 to rotate with the locking portion 14, an outside lever 21 pivotally mounted via a pivot shaft 20 and connected to the outside handle via a motion-transmitting member S, and a subsidiary lever 22 that comprises a first lever 22*a* and a second lever 22*b* as part of a locking mechanism between a locking lever 19 and the outside lever 21 are connected to the front surface of the body 5. The lower end of the first lever 22*a* is pivotally mounted to a free end of the outside lever 21, and a vertical elongate hole 22*c* at the upper part is slidably connected to a projection 19*b* at the lower end of the locking lever 19.

The locking lever 19 can be switched between a lock state and an unlock state with a locking/unlocking knob (not shown) on the door inside the vehicle and a key cylinder (not shown) on the door outside the vehicle. The second lever 22*b* is pivotally coupled at its lower end to a lower end of the first lever 22*a*.

When the engagement unit 2 is connected to the operation unit 3, the locking lever 19 can be switched between the lock state and the unlock state with an actuating member 52 by connecting a forward connecting portion 19*a* to the actuating member 52 (later described of the actuator 4.

The operation unit 3 comprises an approximately L-shaped synthetic resin housing 23. The housing 23 comprises a first case 25 disposed in the door D close to the side of an inner panel D1, and having an operation-mechanism holding portion 24 which is open toward the inside of the vehicle; a second case 26 that extends approximately at right angles toward the outside of the vehicle from the rear end of the vertically middle portion of the first case 25 as a body-holding portion in which the engagement unit 3 is fixed over the rear surface and a synthetic-resin cover 27 that covers an opening of the operation-mechanism holding portion 24 of the first case 25 except the striker-entering groove 10 of the body 5 of the engagement unit 3. Electrical components, such as an operation mechanism 28 including the actuator 4, a switch plate 46 and switches 60, 61, are disposed in the operation-mechanism holding portion 24 of the first case 25.

An outer peripheral wall 251 which projects toward the outside of the vehicle is formed over an upper part of the operation-mechanism holding portion 24 of the first case 25, and a plurality of projections 252 is formed on the outer surface of the outer peripheral wall 251. A plurality of engagement portions 272 which can engage with the projections 252 is provided on an outer peripheral wall 271 which faces the outer peripheral wall 251 of the first case 25 of the cover 27. After the operation mechanism 28 is disposed in the operation-mechanism holding portion 24, the engagement portions 272 engage with the projections 252 of the operation-mechanism holding portion 24, and the outer peripheral wall 251 is made close to the outer peripheral wall 271. The cover 27 covers the operation mechanism 28 in the operation-mechanism holding portion 24, so that the cover 27 is fixed to the first 25.

Figure 7:
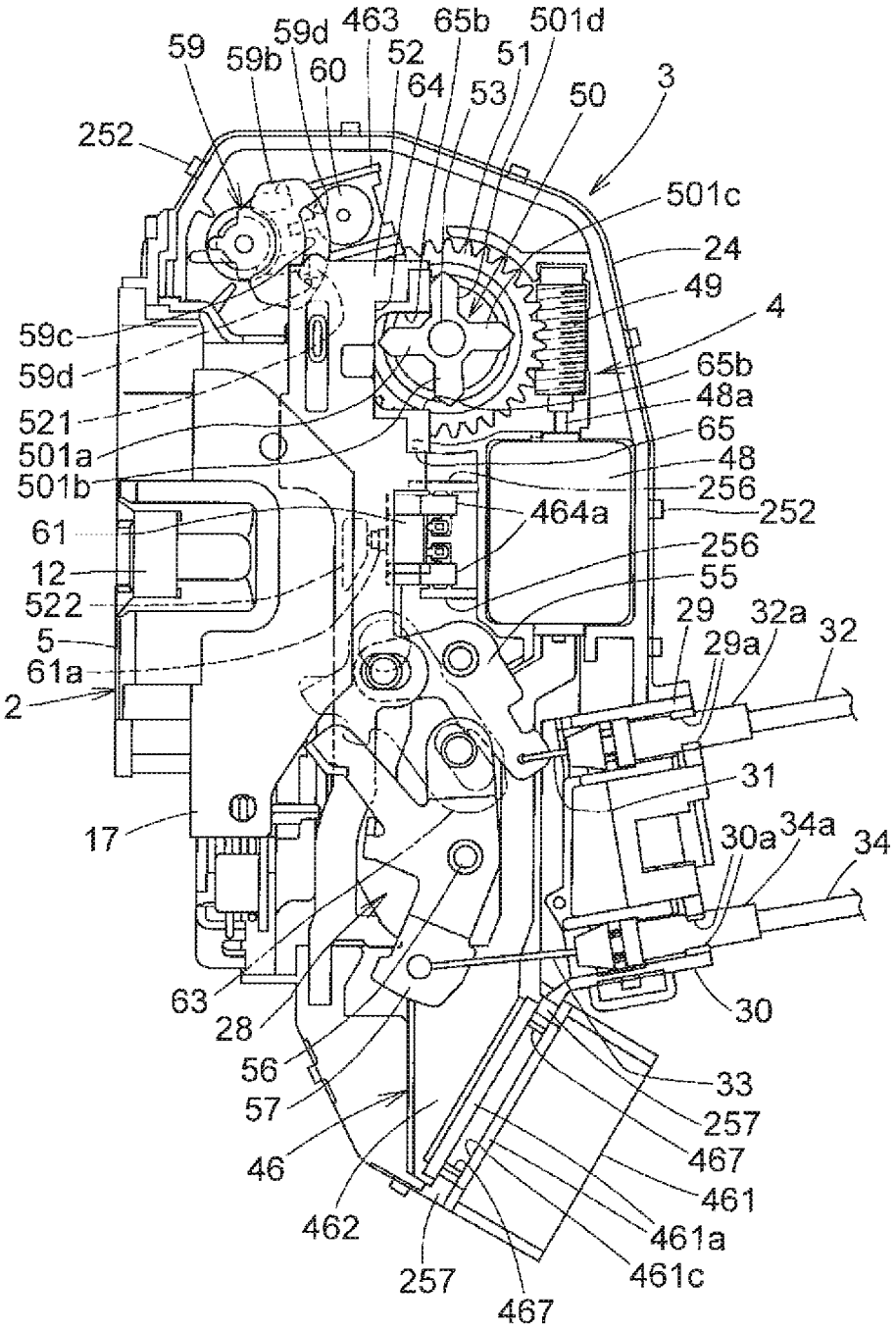
FIG. 7 is a left side elevational view of the door latch device from which a cover is removed (a buffer member 65 is attached on an actuating member 52).

In FIGS. 1 and 7, at a lower front part of the operation-mechanism holding portion 24 of the first case 25, there are provided two upper and lower U-shaped conduit fixing portions 29, 30 that are open toward the inside of the vehicle. Front ends of the conduit fixing portions 29, 30 project forward from the front surface of a watertight top cover 42 later described. Elastically-deformable claws 29*a*, 29*a*, 30*a*, 30*a* project perpendicular to the conduits 32, 34 (later described) on the inner wall surfaces of the conduit fixing portions 29, 30.

A larger-diameter end 32*a* of the conduit 32 fits in the upper conduit fixing portion 29 and is fixed with the elastic claws 29*a*, 29*a*. One end of the conduit 32 is coupled to a locking knob (not shown) on the door inside the vehicle, and the other end has a cable 31 coupled to a knob lever 55 later described. A larger-diameter end 34*a* of the conduit 34 fits in the lower conduit fixing portion 30 and is fixed with the elastic claws 30*a*, 30*a*. One end of the conduit 34 is coupled to an inside handle (not shown) on the door inside the vehicle, and a cable 33 coupled to the inside lever 57 passes through the other end.

Figure 8:
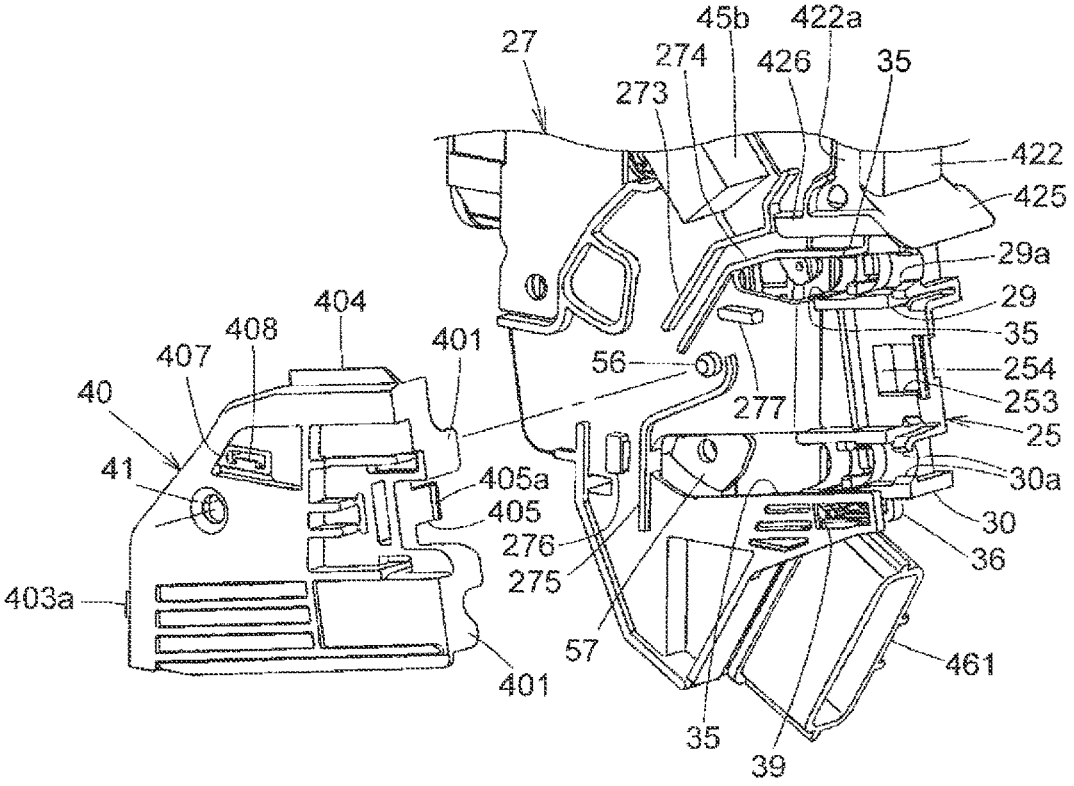
FIG. 8 is an enlarged perspective view of a main part before an auxiliary cover is attached to the cover.
Figure 9:
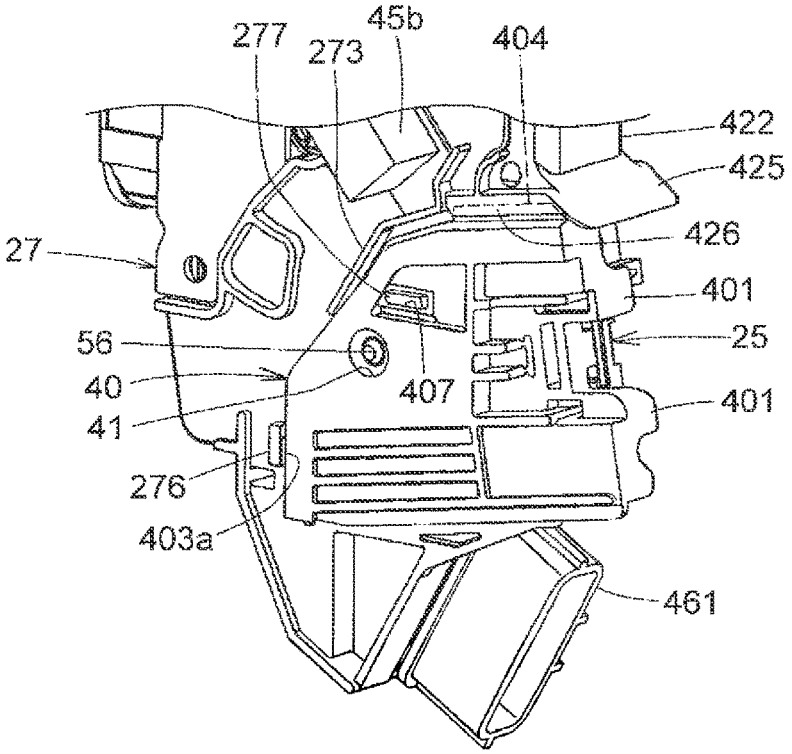
FIG. 9 is an enlarged perspective view after the auxiliary cover is attached.

In FIGS. 1 and 8, there are formed openings 35, 35 that are opens outward and forward in the cover 27 at a part facing the conduit fixing portions 29, 30 of the first case 25. Through the openings 35, 35, the larger-diameter ends 32*a*, 34*a* of the conduits 32, 34 fits in the conduit fixing portions 29, 30. Between the upper and lower openings 35 and 35, the cover 27 projects a little between the upper openings 35 and 35.

Figure 4:
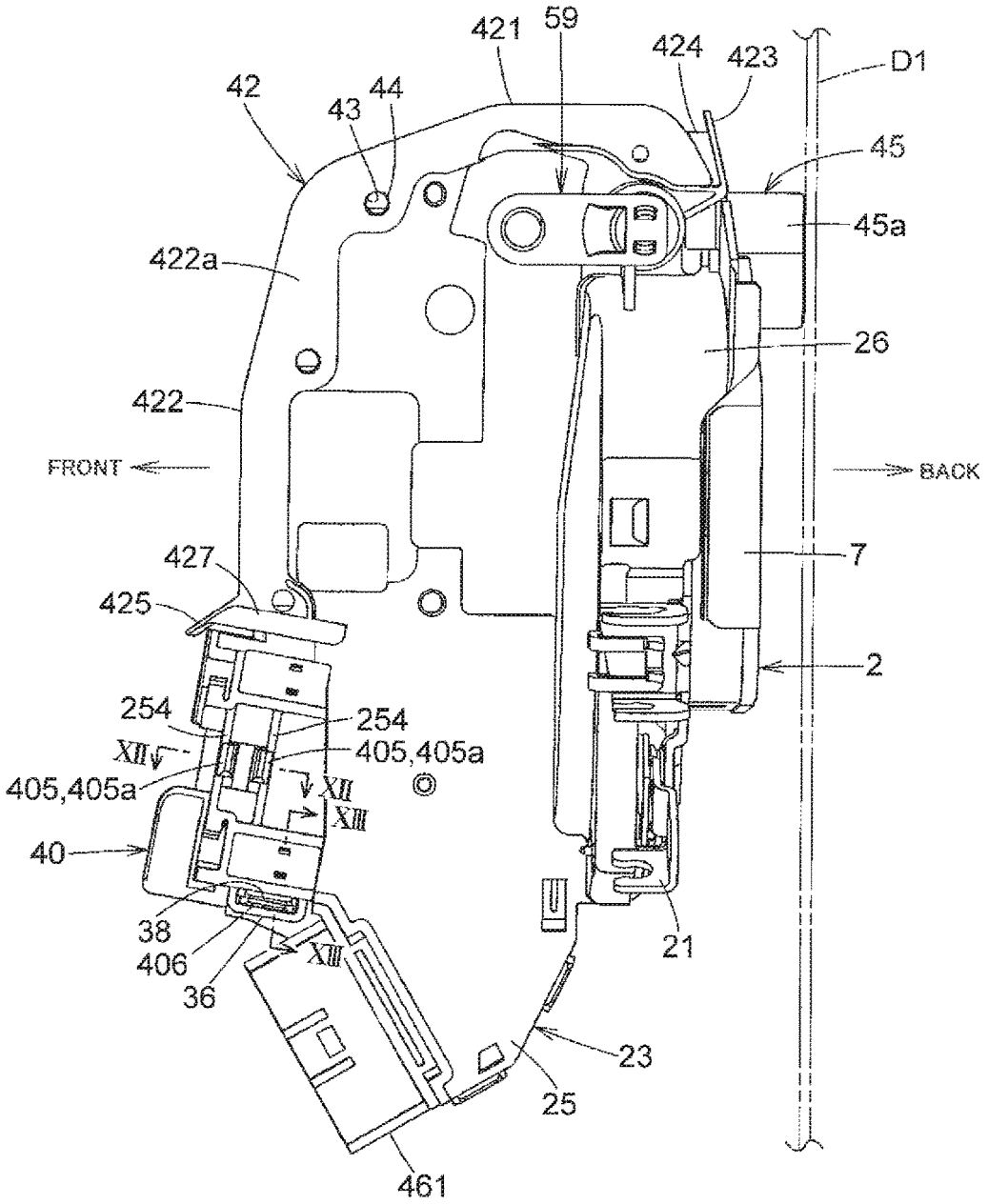
FIG. 4 is a right side elevational view of the door latch device.
Figure 13:
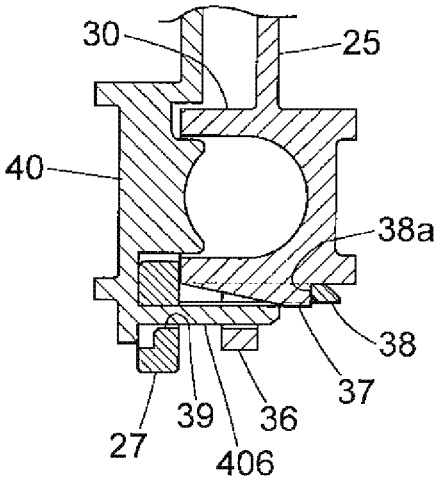
FIG. 13 is an enlarged sectional view taken along the line XIII-XIII in FIG. 4.

In FIGS. 1, 4 and 13, on a lower surface of the lower-conduit fixing portion 30, there are formed a U-shaped holding portion 36 that is open along a width of the vehicle, and an engagement portion 37 is gradually inclined downward toward outside of the vehicle. At the front lower part of the cover 27 facing the holding portion 36, an elastic engagement projection 38 with an engagement hole 38*a* projects toward the outside of the vehicle along the width of the vehicle. When the cover 27 is mounted to the first case 25, the elastic engagement portion 38 fits in the holding portion 36, and the engagement hole 38*a* elastically engages with the engagement projection 38, so that a lower part of the cover 27 is fixed to the first case 25. Slightly under the elastic engagement portion 38 of the cover 27, a slit 39 that can engage with an insert portion 406 of an auxiliary cover 40 is formed to face an inner space of the holding portion 36.

In FIGS. 1 and 8, there are formed a first rain-water guide projection 273, a second rain-water guide projection 274, and a third rain-water guide projection 275 for preventing rain water from flowing down toward the upper and lower openings 35 by guiding rain water that flows down along the side of the cover 27 that faces the interior of the vehicle. The first rain-water guide projection 273 is spaced from a rear part of the upper opening 35 and tilted downward and backward. The second rain-water guide projection 274 is slightly spaced below the first rain-water guide projection 27 and tilted backward and downward along an upper edge of the upper opening 35. The third rain-water guide projection 275 is tilted above a rear part of the lower opening 35 and below a rear part of the second rain-water guide projection 274. A lower half of the third rain-water guide projection 275 extends downward vertically close to the lower opening 35.

Figure 14:
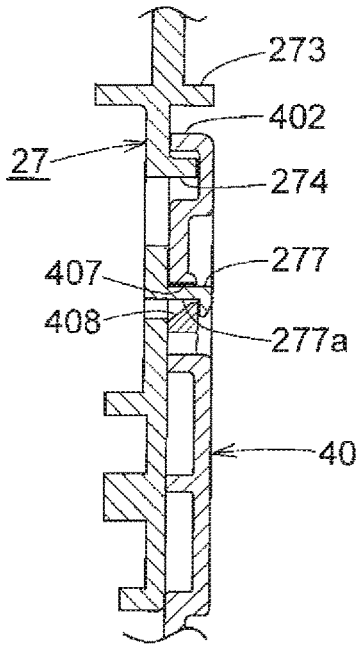
FIG. 14 is an enlarged sectional view taken along the line XIV-XIV in FIG. 5.

Rain water that flows down along the side of the cover 27 facing the inside of the vehicle is received by the first and second rain-water projections 273, 274 and guided backward and downward. Thus, rain water in the door is prevented from flowing into the housing 23 through the upper and lower openings 35 along the side of the cover 27. Between the first rain-water guide projection 273 and the second rain-water guide projection 274, an outer peripheral wall 402 of the auxiliary cover 40 later described is inserted, and a labylinth seal formed by the first and second rain-water guide projections 273, 274 and the outer peripheral wall 402 of the auxiliary cover 40 prevents rain water from flowing into the opening 35 in FIG. 14.

The synthetic-resin auxiliary cover 40 for closing the upper and lower openings 35 to prevent rain water from flowing in is mounted at the side of the cover 27 facing the inside of the vehicle as below.

In FIGS. 5 and 8-10, the auxiliary cover 40 is a trapezoid enough to close the upper and lower openings 1 and the upper and lower conduit fixing portions 29, 30. At upper and lower parts of the front end of the auxiliary cover 40, there are formed pressing portions 401, 401 which can press an outer peripheral surface of the larger-diameter ends 32*a*, 34*a* of the conduits 32, 34 which fits in the conduit fixing portions 29, 30. The upper and lower pressing portions 401 at the front end also act as a cover for covering front openings of the conduit fixing portions 29, 30 except the conduits 32, 34 from front.

Figure 10:
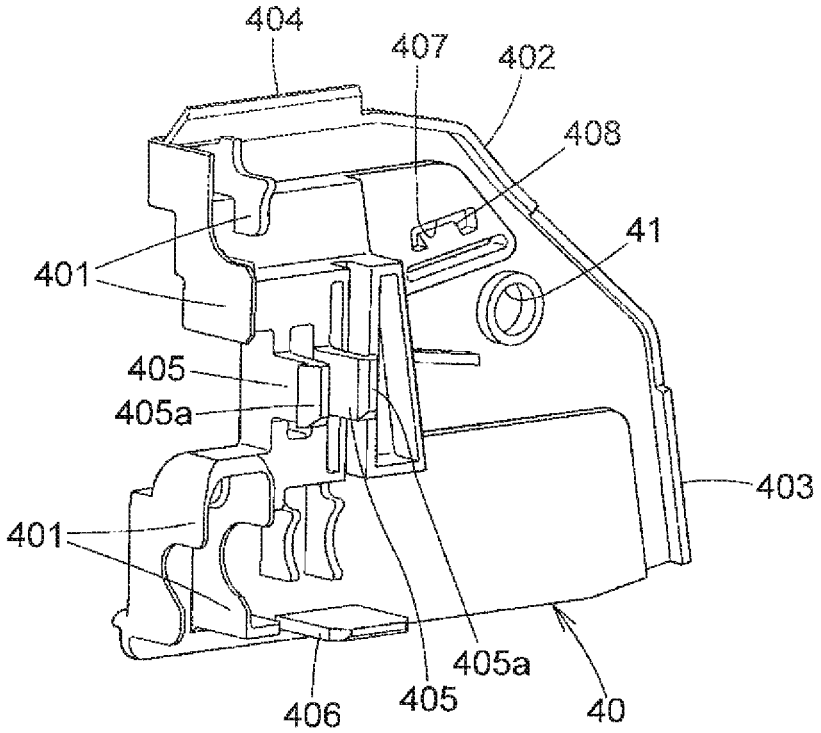
FIG. 10 is an enlarged perspective view of the auxiliary cover seen from back.

In FIG. 10 or a back view, at an upper part of the auxiliary cover 40, there is formed the outer peripheral wall 402 disposed between the first rain-water guide projection 273 and the second rain-water guide projection 274, and at a lower part of a rear edge, there is formed an outer peripheral wall 403 that can contact the side of the cover 27 close to the third rain-water guide projection 275. At an upper end continuous with the outer peripheral wall 402, there is an upward projection 404 covered with a vehicle-inside watertight wall 426 of the watertight top cover 42 later described.

Between the upper pressing portions 401 and 401 at the back surface of the auxiliary cover 40, a pair of elastic engagement portions 405, 405 that have engagement claws 405*a* that are directed oppositely at ends projects. When the auxiliary cover 40 is mounted to the cover 27 in FIG. 8, the elastic engagement portions 405 fits in a rectangular opening 253 formed between the upper and lower conduit fixing portions 29 and 30 of the first case 25, and the engagement claw 405*a* elastically engages with an end face of a pair of engagement portions 254, 254 that projects from the opening 253 in FIG. 12.

At the lower end of the back surface of the auxiliary cover 40, the inserting portion 406 projects. When the auxiliary cover 40 is mounted to the cover 27, the inserting portion 406 passes through a fitting hole 39 of the cover 27 and fits on the U-shaped holding portion of the first case 25 in FIG. 13.

Figure 15:
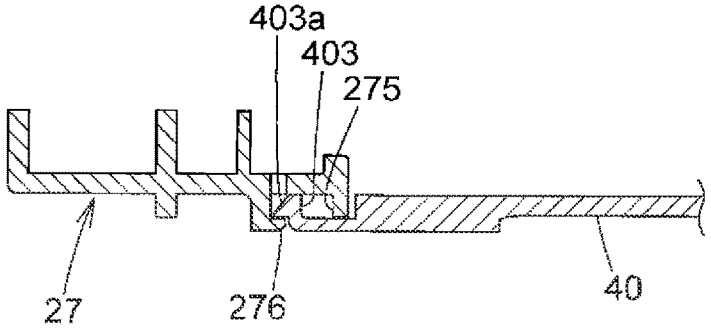
FIG. 15 is an enlarged sectional view taken along the line XV-XV in FIG. 5.

An engagement claw 403*a* projects from the back surface of the outer peripheral wall 403 of the auxiliary cover 40. When the auxiliary cover 40 is mounted to the cover 27 in FIGS. 5, 8 and 9, the engagement claw 403*a* engages with an L-sectioned engagement projection 276 of the cover 27 in FIG. 15.

In FIGS. 8 and 10, an elongate engagement hole 407 is formed at an upper part of the auxiliary cover 40, and an engagement projection 408 which is smaller than a vertical distance of the engagement hole 407 is formed in the middle of an upper surface of the engagement hole 407. A projection 277 projects from the surface of the cover 27 opposite the engagement hole 407 and can fit into the engagement hole 407. In a sectional view of FIG. 14, under the engagement projection 277, there is formed an engagement hole 277*a* into which the engagement projection 408 comes. Through the cover 27 and the auxiliary cover 40, there are formed axial holes 41, 41 into which the end of a support shaft 56 of the inside lever 57 (later described) of the first case 25 fits in FIG. 1.

Figure 12:
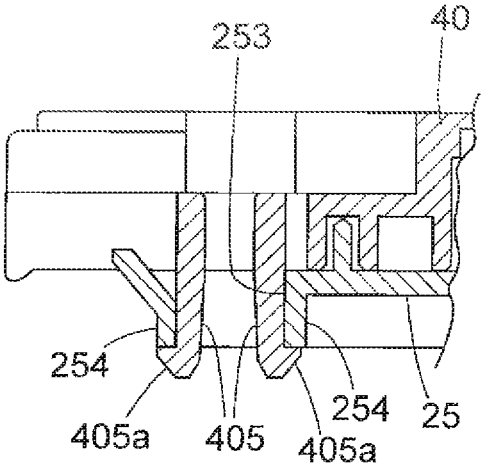
FIG. 12 is an enlarged sectional view taken along the line XII-XII in FIG. 4.

In order to connect the auxiliary cover 40 to the cover 27, a pair of elastic engagement portions 405 of the auxiliary cover 40 is fitted into the opening 253 of the first case 25, and the engagement claw 405*a* of the elastic engagement portion 405 is elastically fitted with the engagement portion 254 of the first case 25 in FIG. 12. The engagement claw 403*a* of the auxiliary cover 40 engages with the engagement projection 27 in FIG. 15, and the engagement projection 277 of the cover 27 fits in the engagement hole 407 of the auxiliary cover 40 in FIG. 14. At the same time, the inserting portion 406 of the auxiliary cover 49 passes through the fitting hole 39 of the cover 27 and fits in the holding portion 36 of the first case 25.

Hence, the auxiliary cover 40 is fixed not to move in any direction to the first case 25 and the cover 27 on or close to the vehicle-interior side of the cover 27 in a forward and upward inclined position. The upper and lower conduit fixing portions 29, 30 of the first case 25 and the upper and lower openings 35 of the cover 27 are closed by the auxiliary cover 40, so that rain water that flows down along the inner side of the cover 27 is unlikely to flow into the housing 23. Furthermore, as mentioned above, because of labylinth seal formed with the first and second rain-water guide projections 273, 274, rain water that flows down along the inner side of the cover 27 is prevented from flowing through the cover 27 and the auxiliary cover 40 into the housing 23. After the auxiliary cover 40 is attached, a front watertight wall 425 of the watertight top cover 42 is positioned right over the front end of the auxiliary cover 40, thereby preventing rain water from flowing into the housing 23 through surrounding portions for the conduits 32, 34 at the conduit fixing portions 29, 30 in FIGS. 5 and 9.

In FIGS. 1 to 6, 16 and 17, the synthetic-resin watertight top cover 42 for preventing rain water from flowing into the operation-mechanism holding portion 24 of the first case 25 is provided over an area from upper surfaces of the first case 25 and the cover 27 of the housing 23 to the upper conduit fixing portion 29. The watertight top cover 42 comprises an upper covering portion 421 that covers whole upper surfaces of the operation-mechanism holding portion 24 and the cover 27 and front and rear vertical surfaces close to the upper surfaces.

Figure 11:
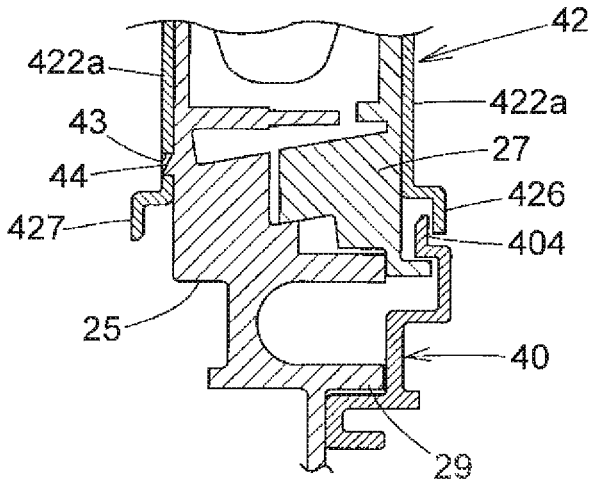
FIG. 11 is an enlarged sectional view taken along the line XI-XI in FIG. 5.

A plurality of fitting holes 43 is formed through a pair of downward portions 421*a* of the upper covering portion 421 and a pair of rearward portions 422*a* of the front covering portion 422. A plurality of protrusions 44 on outer sides of the first case 25 and the cover 27 fits in the fitting holes 43, so that the watertight top cover 42 covers an upper portion and a front portion of a connecting portion of the first case 25 to the cover 27 and surrounds upper parts of the first case 25 and the cover 27 in FIG. 11.

Figure 5:
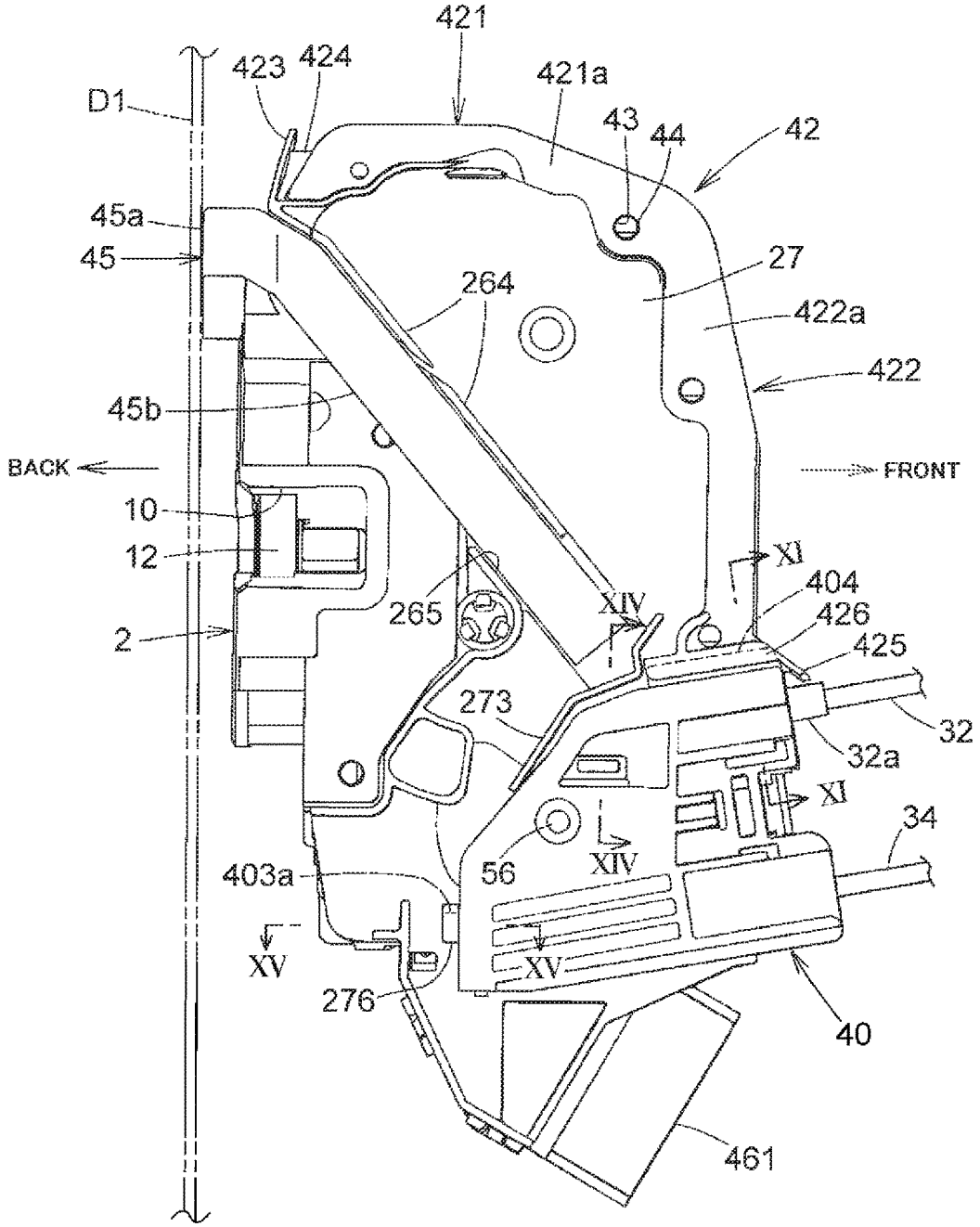
FIG. 5 is a left side elevational view of the door latch device.
Figure 6:
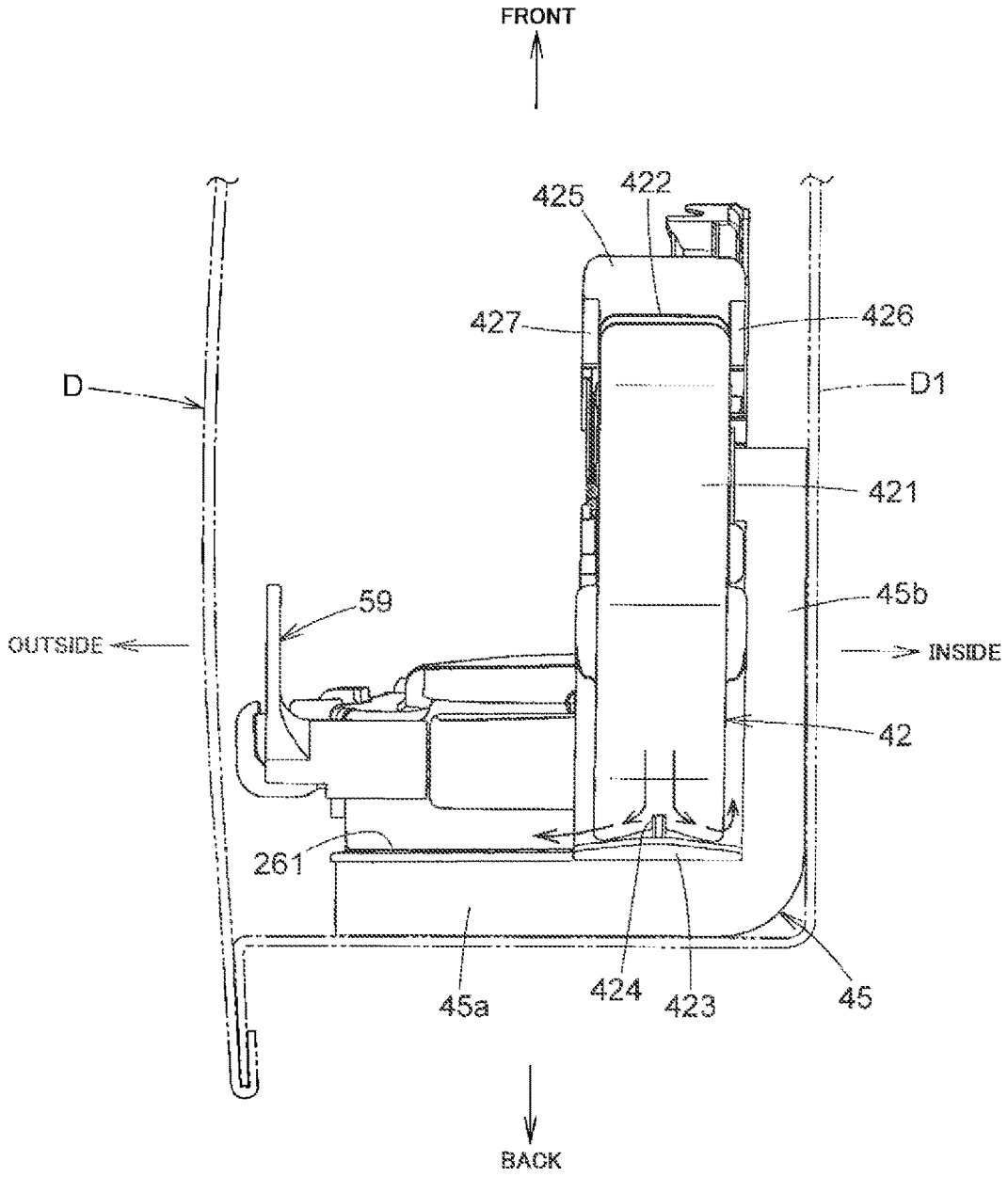
FIG. 6 is a top plan view of the door latch device.
Figure 16:
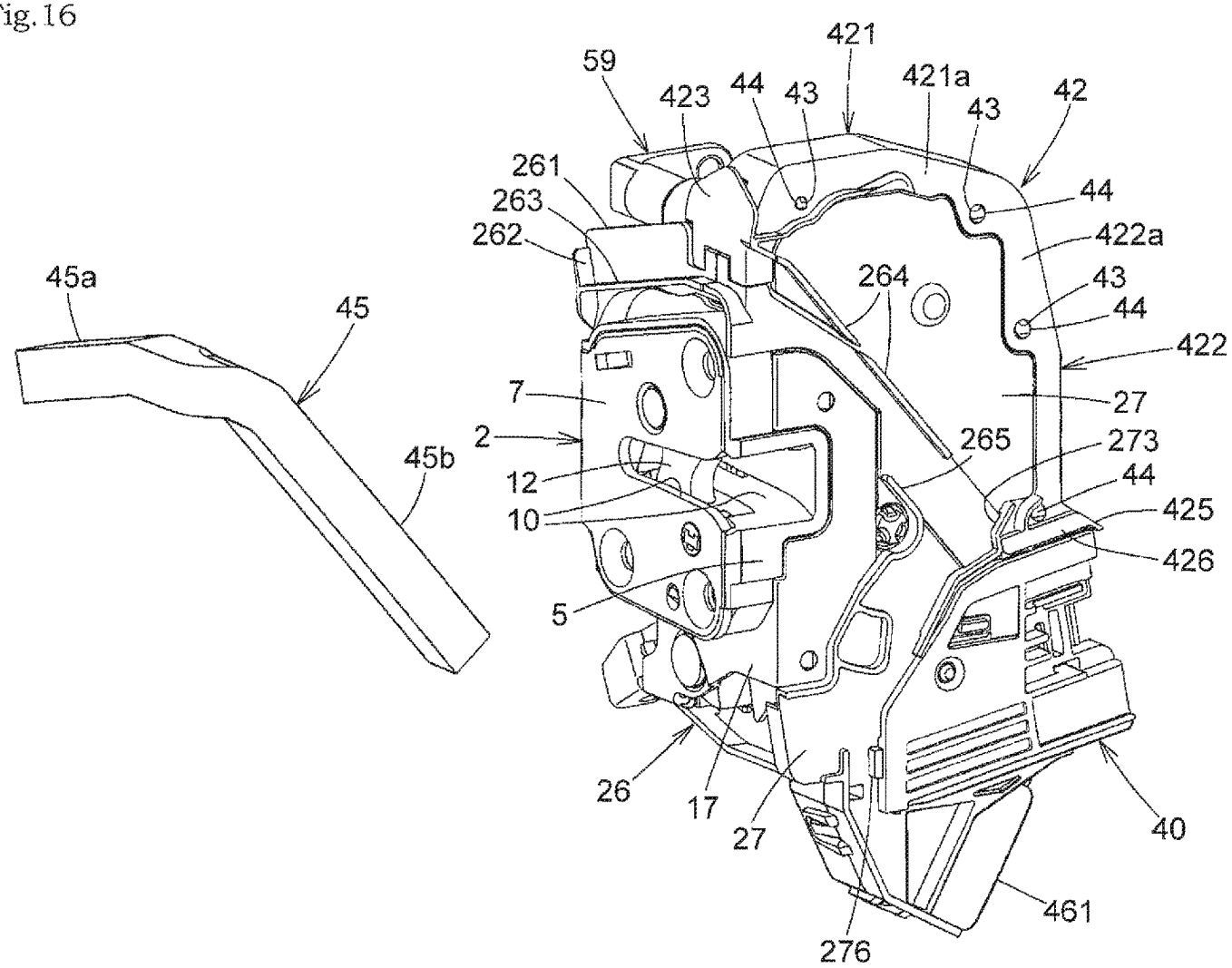
FIG. 16 is a perspective views of the door latch device seen from the interior of a vehicle, and a watertight seal before attachment.

In FIGS. 5, 6 and 16, at the rear end of the watertight top cover 42, a triangular water-shielding wall 423 is continuously formed with the rear end of the upper covering portion 421. The water-shielding wall 423 is slightly wider than the upper covering portion 421 and is approximately as high as the covering portion 421. A partition wall 424 is provided between the water-shielding wall 423 and the upper covering portion 421. By providing the water shielding wall 423 and the partition wall 424, rain water that flows down from the upper surface to the back surface is guided to flow down along a width of the vehicle as shown by arrows in FIG. 6, and is thus prevented from flowing down onto the second case 26 in which the engagement unit 3 is attached. Thus, even if a watertight seal 45 (later described) is deteriorated with aging and is spoiled in watertight capability, rain water is prevented from flowing into the engagement unit 3 and the housing 3.

In FIGS. 4, 5, 8, 9 and 11, at the lower end of the watertight top cover 42, there are formed a front water-shielding wall 425, an inner water-shielding wall 426 and an outer water-shielding wall 427 that are continuous with the lower end of the front covering portion 422 and the lower ends of the inner and outer rearward portions 422*a* respectively. The front water-shielding portion 425 is slightly wider than the housing 23 and is tilted forward and downward to cover the upper ends of the conduit fixing portion 29 of the first case 25 and the auxiliary cover 40. Thus, rain water that flows down on the front covering portion 422 of the watertight top cover 42 is prevented from flowing into the casing 23 through the spaces for the conduits 32, 34 of the conduit fixing portions 29, 30.

The inner water shielding wall 426 is approximately as long as the upward projection 404 of the auxiliary cover 40, and the upward projection 404 is covered with the inner water shielding wall 426 when the watertight top cover 42 is attached to the housing 23. Thus, rain water that flows down along the inner side of the cover 27 and the watertight top cover 42 is guided onto the surface of the auxiliary cover 40. Rain water that flows between the cover 27 and the auxiliary cover 40 is prevented from flowing into the housing 23 through the opening 35 of the cover 27.

In FIGS. 1 to 6, 16 and 17, there is attached a watertight seal 45 over the upper portion of the second case 26 and the cover 27 above the engagement unit 2. The watertight seal 45 made of, for example, a compressible sponge-like sufficient-thickness band, and comprises an upper seal portion 45*a* that is disposed over the rear side of the engagement unit 2 and a side seal portion 45*b* on the inner side of the engagement unit 2. In FIG. 6, the upper seal portion 45*a* faces a rear surface of an inner panel D1 within the door D, while the side seal portion 45*b* faces an inner side surface of the inner panel D1. The watertight seal 45 is adhered with a double-sided adhesive tape or an adhesive coated on a back side.

Above the engagement unit 2 of the second case 26, a seal sticking portion 261 on which the upper seal portion 45*a* of the watertight seal 45 is stuck is tilted downward toward the outside of the vehicle. At the side and lower ends of the seal sticking portion 261, there are projected a first positioning portion 262 for receiving and positioning the side end of the watertight seal 45; and a second positioning portion 263 for receiving and positioning a lower surface of the watertight seal 45. The first positioning portion 262 and the second positioning portion 263 constitute an upper positioning portion. The seal sticking portion 262 also acts as a water-shielding wall for preventing rain water from flowing down toward the engagement unit 2. As shown by the arrows in FIG. 6, the seal sticking portion 261 is formed on or close to the side end of the water shielding wall 423, so that rain water that flows down from the rear surface of the watertight top cover 42 is guided along the seal sticking portion 261 and prevented from flowing down toward the engagement unit 2.

Above the striker-entering groove 10 in the middle of the side of the cover 27, there is formed a third positioning portion 264 for positioning the side seal portion 45*b* of the watertight seal 45 so that the third positioning portion 264 is inclined forward and downward from the rear end of the watertight top cover 42. The third positioning portion 264 is discontinuous, but may be continuous. The upper end of the third positioning portion 264 is continuous with the water shielding wall 423 of the watertight top cover 42. A fourth positioning portion 265 for positioning the side seal portion 45*b* of the watertight seal 45 is spaced from the third positioning portion 264 in parallel on the cover 27. The third positioning portion 264 and the fourth positioning portion 265 constitute a side positioning portion.

In order to attach the watertight seal 45, the end and the lower surface of the upper seal portion 45*a* is contacted with the first positioning portion 262 and the second positioning portion 263 of the second case, so that the upper seal portion 45*a* is positioned vertically and horizontally. Then, the back surface of the upper seal portion 45*a* is stuck to the rear surface of the seal sticking portion 261 and the rear surface of the watertight top cover 42.

The side seal portion 45*b* is bent over the cover 27 and extended along the third positioning portion 264 of the cover 27 forward and downward. The lower end of the side seal portion 45*b* is positioned between the third positioning portion 264 and the fourth positioning portion 264 for vertical and horizontal positioning, and the back surface of the side seal portion 45*b* is stuck to the side of the cover 27. An upper end of the first rain water guide projection 273 also acts as a fifth positioning portion for positioning the lower end of the side seal portion 45*b* and can be an end of a stuck position of the side seal portion 45*b*. The lower end of the side seal portion 45*b* may be on or close to the upper part of the first rain water guide projection 273.

Figure 17:
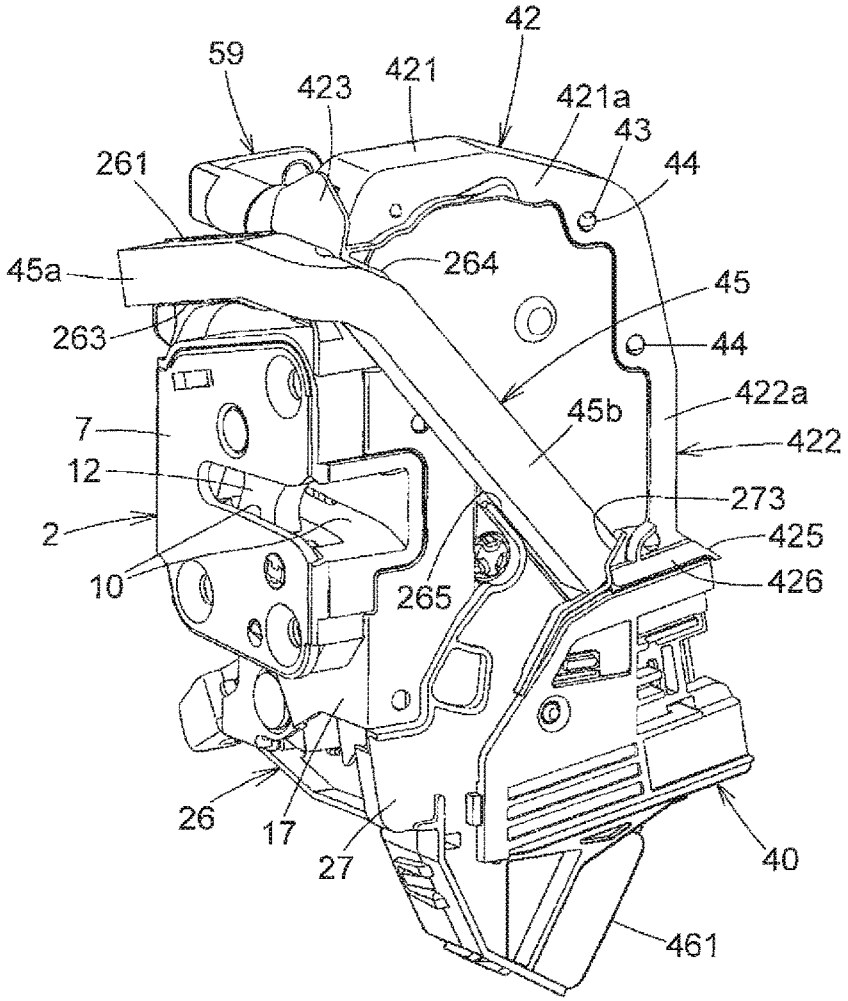
FIG. 17 is a perspective view of the door latch device in which the watertight seal is attached.
Figure 18:
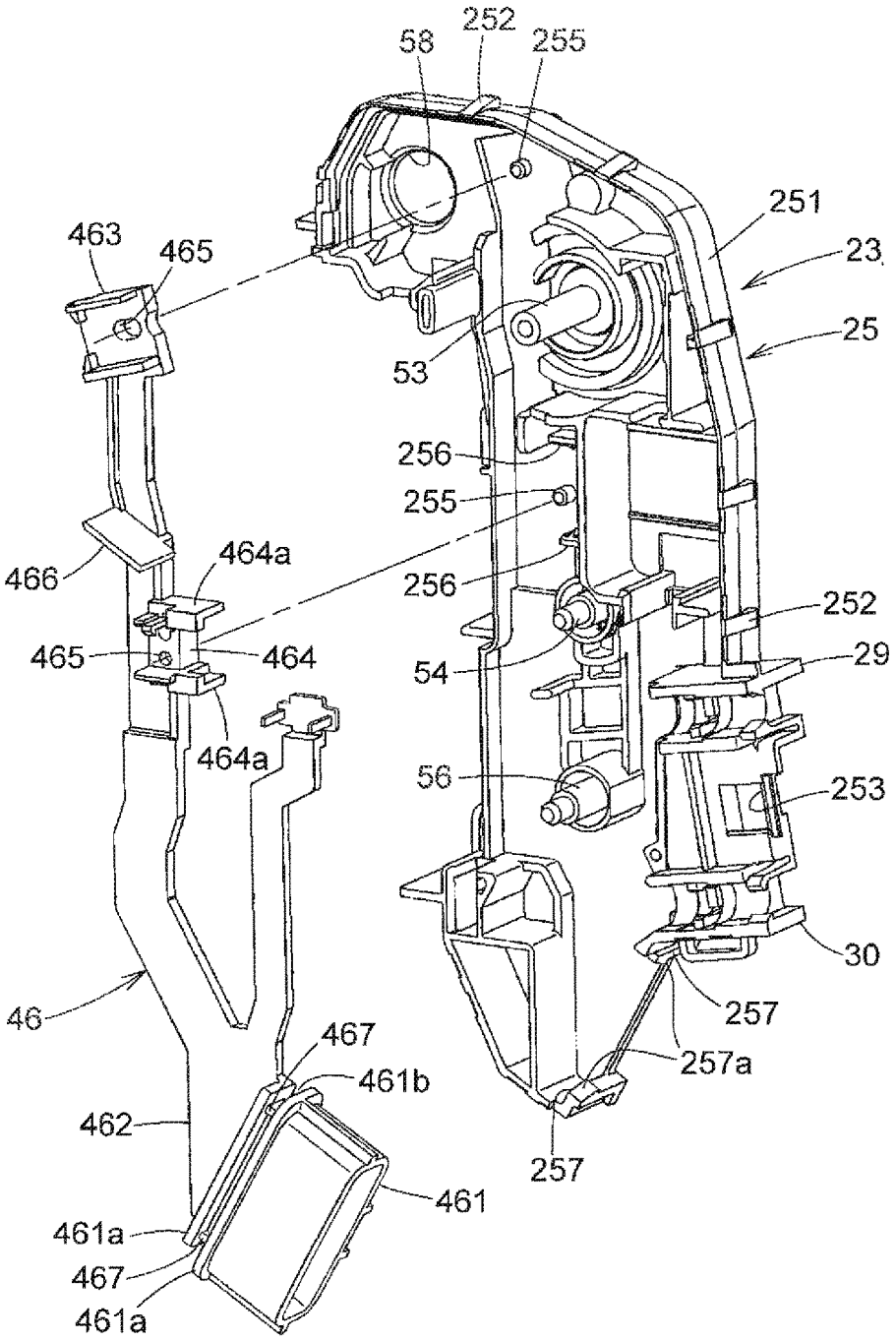
FIG. 18 is enlarged perspective views of a switch plate and a housing before the switch plate is attached.
Figure 19:
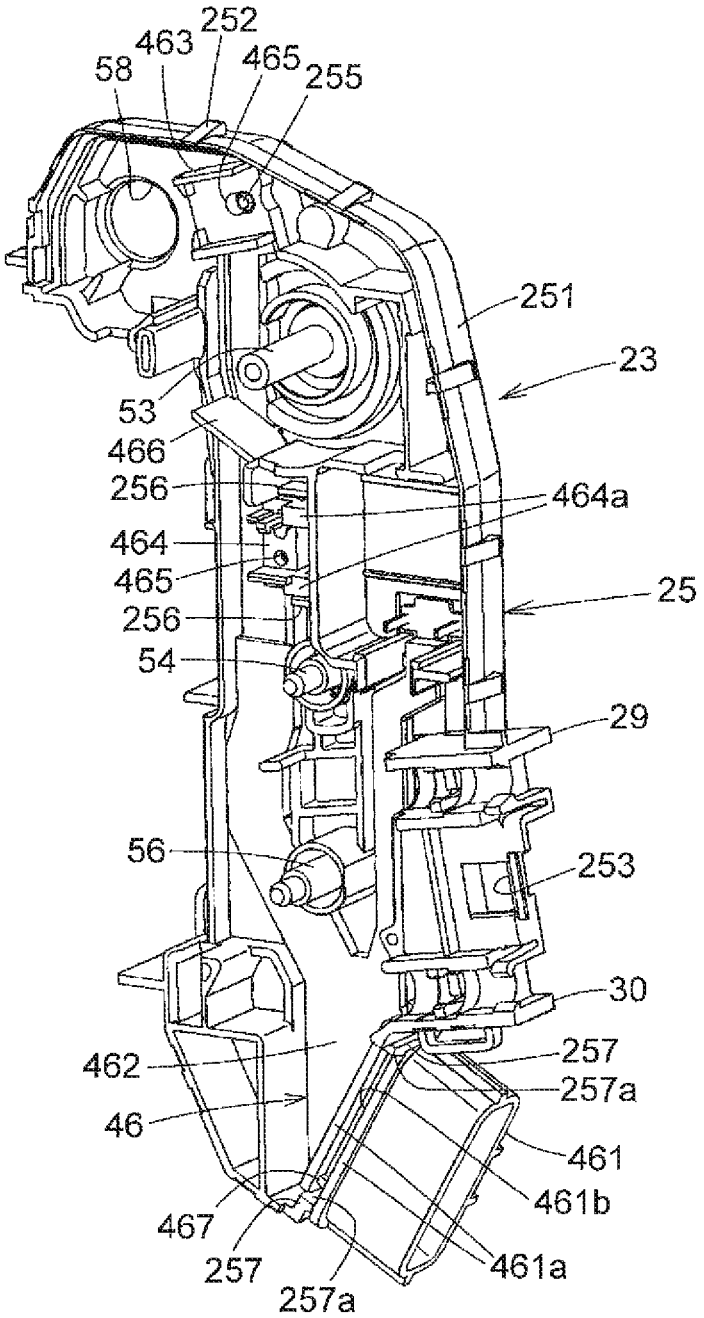
FIG. 19 is an enlarged perspective view of the housing to which the switch plate is attached.
Figure 20:
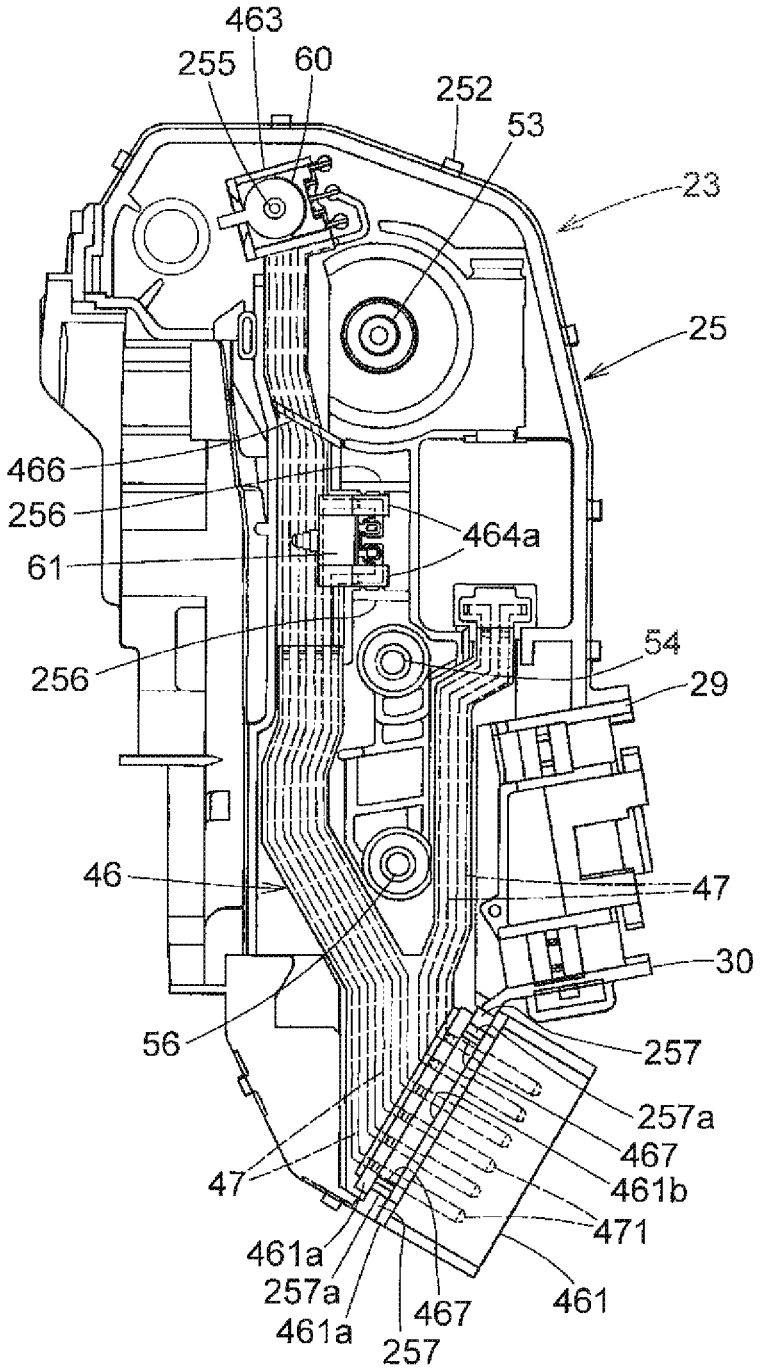
FIG. 20 is a left side elevational view of the housing to which the switch plate is attached.

Thus, as shown mainly in FIG. 17, the watertight seal 45 covers parts above the striker-entering groove 10 formed in the cover member 7 and the body 5 of the engagement unit 3. In order to attach the door latch device 1 in the door D, in FIG. 6, because the upper seal portion 45*b* and the side seal portion 45*b* are contacted on and compressed by the rear surface of the inner panel D1 of the door D and the inner side surface of the inner panel D1, gaps between the engagement unit 3 and the inner panel D1 are closed by the watertight seal 45 and rain water within the door D is prevented from flowing into the striker entering groove 10 from above.

As mentioned above, the water shielding wall 423 is disposed at the watertight top cover 42 to guide rain water which flows down from the rear surface of the watertight top cover 42 along the width of the vehicle, and the seal sticking portion 261 of the second case 26 acts as a shielding wall for guiding rain water which flows down from the rear surface of the watertight top cover 42 toward the outside of the vehicle, so that rain water which flows toward the rear surface of the engagement unit 3 significantly decreases. The watertight seal 45 stuck on the rear surface of the engagement unit 3 is enough to comprise only the upper seal portion 45*a*, so that the watertight seal 45 can be shortened compared with a watertight seal stuck on a conventional door latch device thereby improving sticking performance. Rain water guided by the water shielding portion 423 of the watertight top cover 42 flows down forward and downward along the upper surface of the third positioning portion 264, so that rain water which flows down toward the side seal portion 45*b* of the watertight seal 45 can significantly be reduced.

Furthermore, the first to fourth positioning portions 262, 263, 264, 265 are disposed on the rear surface of the second case 26 and the side surface of the cover 27 to position the watertight seal 45 when it is stuck, thereby making sure of a sticking-start position and a sticking position of the watertight seal 45 and sticking the watertight seal 45 on a predetermined position of the engagement unit 3 and the cover 27 to improve sticking efficiency.

In FIGS. 7 and 18 to 20, there is a vertical switch plate 46 within the operation-mechanism holding portion 24 of the first case 25 of the housing 23. In the switch member 46, a plurality of conductive plates 47 which is conductive with electrical components such as a motor 48, the rotary switch 60 and a limit switch 61 (later described) in the operation-mechanism holding portion 24 are embedded in a synthetic resin 462 by insert molding and integrally molded with a female connector 461 with exposure of a plurality of terminals 471 in the female connector 461 and conductive parts with the motor 48, the rotary switch 60 and the limit switch 61. The synthetic resin 462 used in insert molding is, for example, a mixed resin of PBT (polybutylene telephtalate) resin and ABS resin with a glass fiber.

At the upper end and in the middle of the switch member 46, a rotary switch mounting portion 463 and a limit switch mounting portion 464 with a pair of switch holding portions 464*a*, 464*a* are integrally molded in the synthetic resin 462, and an engagement hole 465 is formed through the mounting portions 463, 464 along the width of the vehicle. Above the limit-switch mounting portion 464, there is projected a contact portion 466 which can come in contact with a back surface of the cover 27 when the cover 27 is attached over the first case 25. The upper and lower switch holding portions 464*a* of the switch mounting portion 464 also acts as an engaged portion which can engage with a first engagement portion 256 (later described) of the first case 25. A terminal of the rotary switch 60 mounted on the rotary switch mounting portion 463 and a terminal of the limit switch 61 on the limit switch mounting portion 464 are fixed to a conductive portion of the conductive plate 47 exposed from the synthetic resin 462 by resistance welding.

The female connector 461 is inclined forward and downward and has brims 461*a*, 461*a* which are spaced from each other at its proximal end. At upper and lower ends of an engagement groove 461*b*, there are formed engaged portions 467, 467 which engages with engagement claws 257*a* of a pair of second engagement portions 257 at the lower end of the first case 25.

At an upper part and in the middle of an inner side of the first case 25 on which the switch member 46 is mounted, there are projected axial projections 255, 255 which fit in the upper and lower engagement holes 465 of the switch member 46. In the middle of the inner side of the first case 25, a pair of engagement portions 256, 256 between which the limit-switch mounting portion 464 of the switch member 46 is elastically held faces each other and surrounds the lower projection 255.

Furthermore, at a part which faces a base end of the female connector 461 of the first case 25, there are provided a pair of second engagement portions 257, 257 which fit in upper and lower portions of the engagement groove 461*b* of the female connector 461, and engagement claws 257*a*, 257*a* which project from the second engagement portions 257, 257 and fit in a pair of engaged portions 467, 467 in the engagement groove 461*b*. The upper and lower projections 255 of the first case 25, the first engagement portions 256, the second engagement portions 257, the switch member 46, and the upper and lower engagement holes 465, the switch holding portions 464*a* and the engaged portions 467 constitute engagement means.

In order to mount the switch member 46 to the first case 25, the upper and lower engagement holes 465 are pressed over the upper and lower projections 255 of the first case 25, and the upper and lower holding portions 464*a* of the limit-switch mounting portion 464 fits between the upper and lower first engagement portions 256 and elastically held. The engagement groove 461*b* of the female connector 461 is pressingly fitted with the two second engagement portions of the first case 25, and the engagement claw 257*a* of the second engagement portion 257 is contacted with an inner end face of the pair of engaged portion 467 in the engagement groove 461*b*. Thus, in FIGS. 19 and 20, the switch plate 46 is firmly mounted to the inner side of the first case 25 without floating or loosening. Only by pushing the switch plate 46 into the first case 25, a plurality of upper and lower engagement means can be fitted, thereby mounting the switch plate 46 to the first case 25 more efficiently.

The switch plate 46 formed separately from the housing 23 by insert molding is mounted to the first case 25, thereby exhibiting a single insert molding. Specifically, it was conventionally necessary to provide two insert molding steps comprising a primary step for molding the switch plate 46 itself by insert molding and a secondary step for fixing the switch plate 46 to the housing 23 by insert molding, but a single insert molding reduces manufacturing cost and the number of steps of a die thereby reducing the cost of the door latch device.

The housing 23 and the switch plate 46 can be molded by different synthetic resins thereby enlarging the degree of freedom in material. For example, the large housing 23 is molded of inexpensive synthetic resin thereby saving material cost. Furthermore, integral molding of the female connector 461 with the switch plate 46 achieves good watertight capability.

Then, the structure of the operation mechanism 28 that includes the locking/unlocking actuator 4 installed in the operation-mechanism holding portion 24 in the first case 25 of the housing 23 will be described.

In FIGS. 1 and 7, the actuator 4 is vertically disposed in the operation-mechanism holding portion 24 without play, and comprises a reversible motor 48 actuated with a remote control switch (not shown); a worm 49 fixed to a rotary shaft 48*a* extending upward of the motor 48; a worm wheel 51 driven by the worm 49, a cross-shaped drive portion 50 fixed on an inner rotary surface of the worm wheel 51; and a vertical actuating member 52 that moves between an upper lock position and a lower unlock position. The worm wheel 51 is rotatably supported via a pivot shaft 53 that projects from an inner side of the operation-mechanism holding portion 24.

The knob lever 55 of the operation mechanism 28 is pivotally mounted via a pivot shaft 54 in the middle of the operation-mechanism holding portion 24. The knob lever 55 is connected to the actuating member 52, and is connected to a locking knob (not shown) on an inner side of the door. With the locking knob, the actuating member 52 moves upward or downward. The locking lever 19 connected to the actuating member 52 is switched to a lock state or an unlock state.

The inside lever 57 is pivotally mounted via a pivot shaft 56 in the middle of the operation-mechanism holding portion 24. The inside lever 57 is connected to a steering wheel (not shown) via the cable 33 of the conduit 34, and rotates in an unlocking direction (counterclockwise in FIG. 7) with opening action of the steering wheel.

A key lever 59 is mounted through a hole of an upper part of the operation-mechanism holding portion 24. A connecting arm 59*a* of the key lever 59 which projects from the first case 25 toward the outside of the vehicle is connected to a key cylinder (not shown) of the door. A sector-shaped connecting portion 59*b* which is connected with the actuating member 52 is formed forward, and an arcuate recess 59*c* is formed at a front end of the connecting portion 59*b*. A projection 521 at the upper end of the actuating member 52 fits in the recess 59*c*.

When the locking lever 19 is in a lock state, the key cylinder is operated for unlocking, and the key lever 59 rotates clockwise from a neutral position in FIG. 7. An upper stop 59*d* of the recess 59*e* of the key lever 59 comes in contact with the projection 521 of the actuating member 52 from above, so that the actuating member 52 is moved from an upper lock position to a lower unlock position m FIG. 7, and the locking lever 19 is switched to the lock state via the actuating member 52. Switching action to the lock/unlock position is detected by the rotary switch 60 mounted on a rotary-switch mounting portion 463 of the switch member 46.

When the locking lever 19 is in an unlock state, the key cylinder is operated for locking, and the key lever 59 rotates counterclockwise from the neutral position. A lower step 59*d* of the recess 59*c* comes in contact with the projection 521 from below, and the actuating member 52 is moved from the lower unlock position to the upper lock position, so that the locking lever 19 is switched to the lock state via the actuating member 52. The switching action to the lock/unlock position is detected by the rotary switch 60 mounted on the rotary-switch mounting portion 463 of the switch member 46.

When the actuating member 52 is moved to the lock position and the unlock position, the limit switch 61 mounted on the limit-switch mounting portion 464 in the middle of the switch member 46 is actuated, so that the motor 48 of the actuator 4 stops. Specifically, in FIG. 7, when the actuating member 52 moves to the lock position and the unlock position, a stretchable projection 61*a* of the limit switch 61 comes in contact with an actuating projection 522 projecting on the outer side of the actuating member 52, thereby generating "on" or "off" stop signal for stopping the motor 48.

In FIG. 1, an axial hole 62 is formed in the middle of the cover 27, and an override lever 63 connected to the inside lever 57 is supported in the axial hole 62. Regardless of the state of the locking mechanism, the override lever 63 cancels the engagement of the engagement mechanism 9 to enable the door to open.

A drive portion 50 for the worm wheel 51 comprises two locking/unlocking drive projections 501*a*, 501*b* that are adjacent to each other and can move the actuating member 52 to a lock position or an unlock position, and two stopping projections 501*c*, 501*d* that are opposite to the locking/unlocking drive projections 501*a*, 501*b* and can stop rotation of the worm wheel 51 and the drive portion 50.

The locking/unlocking drive projections 501*a*, 501*b* and the stopping projections 501*c*, 501*d* extend outward of the worm wheel 51 around a support shaft 53, and are spaced by 90 degrees circumferentially to form a cross. Each of the projections 501*a* to 501*d* is shorter than a radius of the worm wheel 51. The locking/unlocking drive projections 501*a*, 501*b* have a length enough to move the actuating member 52 to the upper lock position and the lower unlock position.

The actuating member 52 has a recess 64 at an upper part opposite the drive portion 50. The recess 50 is open toward the drive portion 50, and a noise-reducing buffer member 65 is fixed in the recess 64. The buffer member 65 has a U-shaped recess 65*a* that is open toward the drive portion 50. The locking/unlocking drive projections 501*a*, 501*b*, can get in and out of the recess 65*a*. Upper and lower opposite surfaces of the recess 65*a* are driven surfaces with which the locking/unlocking drive projections 501*a*, 501*b* can come in contact. The buffer member 65 is formed of polyester elastomer (TM: Hytrel) with suitable hardness and elasticity.

Figure 21:
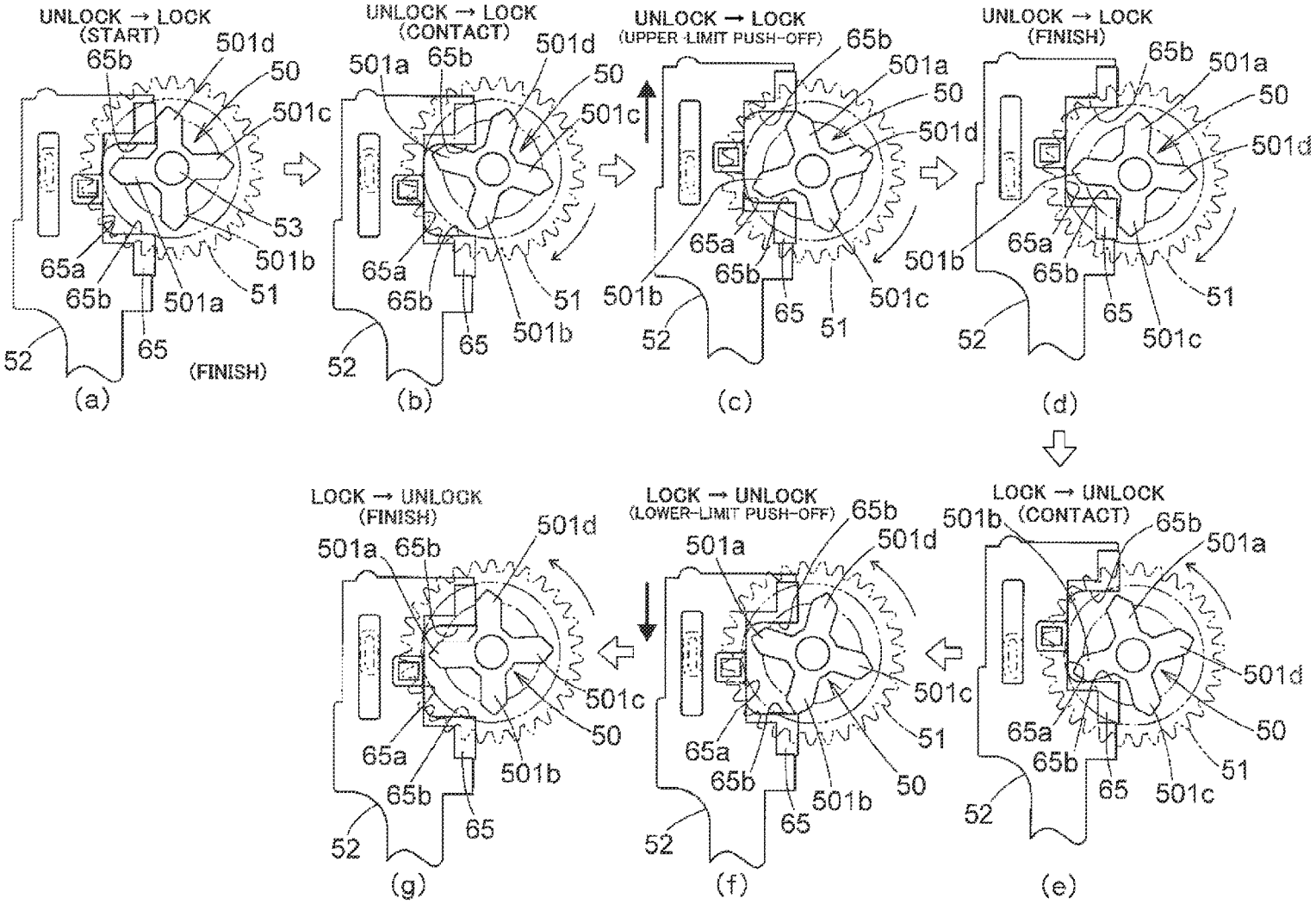
FIG. 21 is left side elevational views showing a motion of the actuator when an actuating member moves to a lock position and an unlock position.

In FIG. 21, the depth of the recess 65*a* is defined so that the ends of the locking/unlocking drive projections 501*a*, 501*b* can rotate without contacting the bottom of the recess 65*a* when the drive portion 50 is rotating. The vertical distance of the recess 65*a* is defined so that the locking/unlocking drive projections 501*a*, 501*b* may both come in the recess 65*a* when the actuating member 52 is moved upward or downward with rotation of the drive portion 50. According to locking/unlocking action of the knob lever 55 or key cylinder as manually-operating means, the actuating member 52 is able to move to the lock position in FIG. 21 (*d*) and the unlock position in FIGS. 21 (*a*), (*g*). Thus, when the actuating member 51 is moved by the manually-operating means from the lock position to the unlock position or vice versa, in order that movement of the actuating member 52 may be allowed or in order that the upper and lower driven surfaces 65*b* may not be contacted with the locking/unlocking drive projections 501*a*, 501*b* which come and stay in the recess 65*a*, both the driven surfaces 65*b* are spaced from each other, so that there is a space slightly greater than a stroke of the actuating member 52 between the locking/unlocking drive projections 501*a*, 501*b* and the upper and lower driven surfaces 65*b*.

Then, the actuator 4 will be described with respect to motion in FIG. 21.

FIG. 21 (*a*)-(*d*) shows that the actuating member 52 in the unlock position is moved to the lock position. FIG. 21(*a*) shows a motion-starting position where the actuating member 52 is at a lower unlock position and the motor 48 of the actuator 4 is at rest with a stop signal of the limit switch 61. In FIG. 21(*a*), the locking/unlocking drive projection 501*a* of the drive portion 50 gets into the recess 65*a* and is at rest close to the upper driven surface 65*b*. The upper stopping projection 501*d* adjacent to the locking/unlocking drive projection 501*a* is in contact with a front face of an upper part of the buffer member 65 opposite it, and the drive portion 50 is at rest and does not rotate.

In FIG. 21(*a*), the motor 48 of the actuator 4 is normally rotated with the remote control switch, and as shown in FIG. 21(*b*), the worm wheel 51 and the drive portion 50 start rotating clockwise. The locking/unlocking drive projection 501*a* in the recess 65*a* comes in contact with the upper driven surface 65*b* of the recess 65*a* from below. At the same time, the other locking/unlocking drive projection 501*b* adjacent to the locking/unlocking drive projection 501*a* starts getting into the recess 65*a*.

The worm wheel 51 and the drive portion 50 rotates clockwise further, and in FIG. 21(*c*), by a rotation force of the locking/unlocking drive projection 501*a*, the actuating member 52 is pushed up straight, and the actuating member 52 continues pushing up right before the end of the locking/unlocking drive projection 501*a* leaves the upper driven surface 65*b*. This is an upper-limit push-off position of the actuating member 2, and the actuating member 52 is moved upward to the unlock position. The other locking/unlocking drive projection 501*b* gets into the recess 65*a* deeply.

The worm wheel 51 and the drive portion 50 rotates clockwise further from FIG. 21(*c*), and the end of the locking/unlocking drive projection 501*a* leaves the upper driven surface 65*b*. Simultaneously, the stopping projection

501*c* opposite the locking/unlocking drive projection 501*a* comes in contact with a front face of a lower part of the buffer member 65. The drive portion 50 stops at the lock position. In this state, the other locking/unlocking drive projection 501*b* stops at a position close to the lower driven surface 65*b*. At the same time with the contact, the limit switch 61 acts, a signal generated thereby stops the motor 48, and the actuator 4 stops. When the actuating member 52 is moved to the upper lock position by the actuator 4, the locking lever 19 connected to the actuating member 52 is switched to the lock state, so that the door cannot be opened.

FIG. 21 (*e*) to (*g*) shows that the actuating member 52 is moved from the lock position to the unlock position. In FIG. 21(*d*), the motor 48 is rotated reversely with the remote control switch. The worm wheel 51 and the drive portion 50 start rotating reversely and the other locking/unlocking drive projection 501*b* which is at rest in the recess 65*a* comes in contact with the lower driven surface 65*b* of the recess 65*a* from above. Simultaneously, the locking/unlocking drive projection 501*a* gets into the recess 65*a*.

The worm wheel 51 and the drive portion 50 rotate counterclockwise further, and in FIG. 21(*f*), the actuating member 52 is pushed down straight by a rotation force of the locking/unlocking drive projection 501*b*. Downward movement of the actuating member 52 continues right before the end of the locking/unlocking drive projection 501*b* leaves the lower driven surface 65*b*. This is a lower-limit put-off position of the actuating member 52 which moves down to the unlock position. The locking/unlocking drive projection 501*a* gets into the recess 65*a* deeply.

The worm wheel 51 and the drive portion 50 rotate counterclockwise further slightly from FIG. 21(*f*), and as shown in FIG. 21(*g*), the end of the other locking/unlocking drive projection 501*b* leaves the lower driven surface 65*b*. Simultaneously, the stopping projection 501*d* opposite the locking/unlocking drive projection 501*b* comes in contact with a front face of an upper part of the buffer member 65, and the drive portion 50 stops at the unlock position. The motion finishing position is the same as the motion starting position in FIG. 21(*a*), and thus, with normal rotation of the motor 48 of the actuator 4, the actuating member 52 can be moved from the unlock position to the lock position. The actuating member 52 is moved to the lower unlock position by the actuator 4, and the locking lever 19 connected to the actuating member 52 is switched to the unlock state to enable the door to open.

The foregoing description relates to a case that the actuating member 52 in the unlock position is moved with normal/reverse rotation of the drive portion 50 to the lock position and the unlock position. If, in FIG. 21(*a*), the actuating member 52 is moved up to an upper lock position in FIG. 21(*d*) by the manually-operating means such as the knob lever 55 and is moved down to the lower unlock position by the actuator 4, the drive portion 50 can be rotated counterclockwise in FIG. 21(*a*). Then, the locking/unlocking drive projection 501*a* comes in contact with the lower driven surface 65*b* of the actuating member 52 in the upper lock position in FIG. 21(*e*), so that the actuating member 52 is moved down to the lower unlock position in FIG. 21(*f*).

If the actuating member 52 in FIG. 21(*d*) is moved down to the lower unlock position in FIG. 21(*a*) by the manually-operating means such as the knob lever 55 and moved up to the upper lock position by the actuator 4, the drive portion 50 is rotated clockwise reversely to the above. Then, the other locking/unlocking drive projection 501*b* comes in contact with the upper driven surface 65*b* of the actuating member 52 in the lower unlock position such as in FIG. 21(*b*), so that the actuating member 52 is moved up to the upper lock position in FIG. 21(*c*).

As mentioned above, in the actuator 4 in the embodiment, the drive portion 50 that moves the actuating member 52 to the lock position and the unlock position comprises the two locking/unlocking drive projections 501*a*, 501*b*, and the two stopping projections 501*c*, 501*d*. The projections 501*a*, 501*b*, 501*c*, 501*d* are spaced from each other by 90 degrees circumferentially. When the actuating member 52 is at rest in the lock position and the unlock position, the locking/unlocking drive projections 501*a*, 501*b* are positioned in the recess 65*a* of the actuating member 52, and on the way that the actuating member 52 moves to the lock position or the unlock position, the locking/unlocking drive projections 501*b*, 501*a* get into the recess 65*a* together. When the drive portion 50 rotates normally and reversely, the actuating member 52 is moved to the lock position and the unlock position with the locking/unlocking drive projections 501*a*, 501*b*, and when the actuating member 52 is moved to the lock position and the unlock position, the stopping projections 501*c*, 501*d* come in contact with the actuating member 52, and the drive portion 50 stops from rotation, thereby reducing operation time of the motor 48 and a rotation angle of the worm wheel 51 until the actuating member 52 and the locking lever 19 connected to the actuating member 52 are moved from the unlock position to the lock position and vice versa and stopped by the actuator 4. Thus, it reduces operation time of the actuator 4 for turning the lock state and the unlock state with the switch such as the remote control switch.

Each of the projections 501*a* to 501*d* comes in contact with the noise-reducing buffer member 65 of the actuating member 52 thereby reducing impact noise at the contact.

The operation starting position in FIG. 21(*a*) before the actuating member 52 is moved from the unlock position to the lock position is the same as the operation finishing position in FIG. 21(*g*) after the actuating member 52 is moved from the lock position to the unlock position. It is not necessary for the worm wheel 51 to move back to the starting position after moved to each position, or it is not necessary to provide a return spring.

When the actuating member 52 is moved to the lock position or the unlock position by the manually-operating means such as the knob lever 55 and a key cylinder, the upper and lower driven surfaces 65*b* do not come in contact with the locking/unlocking drive projections 501*a*, 501*b*. Hence, the worm wheel 51 or the motor 48 is not rotated with the locking/unlocking drive projections 501*a*, 501*b*, and the actuating member 52 can be moved by the manually-operating means by a small force.

The foregoing relates to the embodiment of the invention. But the following changes and variations may be made without departing from the gist of the invention as below:

In the embodiment, in order to reduce an axial distance of the drive portion 50 of the actuator 4, the actuating member 52 is disposed opposite the drive portion 50, and the upper and lower surfaces of the recess 65*a* of the actuating member 52 opposite the drive portion 50 are the driven surfaces 65*b*, 65*b*. The locking/unlocking drive projections 501*a*, 501*b* come in contact with the upper and lower driven surfaces 65*b*, 65*b*. Instead of the recess 65*a*, the actuating member 52 may be spaced axially from the drive portion 50, and a pair of upper and lower driven portions which project toward the drive portion 50 may be provided at the actuating member 52. Surfaces of the upper and lower driven portions can be contact portions with which the stopping projections 501*c*, 501*d* come in contact.

In the foregoing embodiment, a rotating object is the worm wheel 51, but may be a spur gear. A small gear which meshes with the spur gear may be fixed to a rotary shaft of the motor 48.

In the foregoing embodiment, the noise-reducing buffer member 65 is disposed on the actuating member 52, but may be attached on the two locking/unlocking drive projections 501*a*, 501*b* and the two stopping projections 501*c*, 501*d*.

What is claimed is:

1. A door latch actuator comprising:

a reversible motor;

a rotating object rotated by the motor forwardly and reversely;

a drive portion rotated forwardly and reversely together with the rotating object and comprising two adjacent locking/unlocking drive projections and two adjacent stopping projections opposite the two locking/unlocking drive projections, the four projections being spaced from each other circumferentially by approximately 90 degrees; and an actuating member that comprises a pair of driven portions and contact portions to move from a lock position in which a locking mechanism of a door is in a lock state to an unlock position in which the locking mechanism is in an unlock state and vice versa owing to forward reverse rotation of the drive portion or locking/unlocking operation of manually-operating means, wherein the two locking/unlocking drive projections are able to come in contact with the pair of driven portions respectively when the drive portion rotates and the pair of driven portions of the actuating member is spaced so that the actuating member is moved to the unlock position or the lock position by the manually operating means, and wherein when one of the two locking/unlocking drive projections is positioned between the pair of driven portions and when the drive portion rotates, the locking/unlocking drive projection positioned between the pair of driven portions comes in contact with one of the pair of driven portions thereby moving the actuating member toward the lock position or the unlock position, during the movement of the actuating member, the other locking/unlocking drive projection which does not move the actuating member comes in between the pair of driven portions at the same time, when the actuating member moves to the lock position or the unlock position, the locking/unlocking drive projections positioned between the pair of driven portions leaves one of the pair of driven portions, and one of the two adjacent stopping projections opposite the locking/unlocking drive projection which leaves one of the pair of driven portions comes in contact with one of the pair of contact portions thereby stopping rotation of the drive portion.

2. The door latch actuator of claim 1 wherein the actuating member is disposed opposite the drive portion and a recess which is open opposite the drive portion is termed in the actuating member opposite the drive portion, an opposite surface in the recess being one of the pair of driven portions with which the locking/unlocking drive projections come in contact, a surface which faces the drive portion across the recess being one of the pair of contact portions which comes in contact with one of the pair of stopping projections.

3. The door latch actuator of claim 1 wherein a noise-reducing buffer member is attached on the two locking/unlocking drive projections or the pair of driven portions contacted by the two locking/unlocking drive projections, and on the two adjacent stopping projections or the pair of contact portions contacted by the two adjacent stopping projections.

4. The door latch actuator of claim 1 wherein the actuating member is moved straight by the two locking/unlocking drive projections.

5. The door latch actuator of claim 1 wherein the rotating object is a worm wheel.

6. The door latch actuator of claim 1 wherein the manually-operating means is a knob lever.

7. The door latch actuator of claim 1 wherein the manually-operating means is a key cylinder.

* * * * *